US005215848A

United States Patent [19]

Ikeda et al.

[11] Patent Number: 5,215,848

[45] Date of Patent: Jun. 1, 1993

[54] CARRIER FOR ELECTROPHOTOGRAPHY, TWO-COMPONENT TYPE DEVELOPER, PROCESS FOR PRODUCING CARRIER AND IMAGE FORMING METHOD

[75] Inventors: Takeshi Ikeda; Yukou Sato, both of Yokohama, Japan

[73] Assignee: Canon Kabushiki Kaisha, Tokyo, Japan

[21] Appl. No.: 607,035

[22] Filed: Oct. 31, 1990

[30] Foreign Application Priority Data

Oct. 31, 1989 [JP] Japan ..... 1-285901
May 8, 1990 [JP] Japan ..... 2-119459
May 8, 1990 [JP] Japan ..... 2-119460

[51] Int. Cl.[5] ..... G03G 9/113; G03G 13/08

[52] U.S. Cl. ..... 430/108; 428/407; 430/120; 430/106.6

[58] Field of Search ..... 430/108, 120; 428/407

[56] References Cited

U.S. PATENT DOCUMENTS

| | | | |
|---|---|---|---|
| 2,297,691 | 10/1942 | Carlson . | |
| 3,655,374 | 4/1972 | Palermiti et al. | 430/109 |
| 3,666,363 | 5/1972 | Tanaka et al. . | |
| 3,916,064 | 10/1975 | Brown | 428/403 |
| 4,039,463 | 8/1977 | De Roo et al. | 430/108 |
| 4,071,361 | 1/1978 | Marushima . | |
| 4,093,459 | 6/1978 | Westdale et al. | 430/108 |
| 4,272,601 | 6/1981 | Tokura | 430/108 |
| 4,822,708 | 4/1989 | Machida et al. | 430/108 X |
| 4,834,920 | 5/1989 | Bugner | 430/110 |
| 4,868,082 | 9/1989 | Kohri et al. | 430/108 X |
| 5,071,726 | 12/1991 | Maniar | 430/108 X |

FOREIGN PATENT DOCUMENTS 62-229256 10/1987 Japan .

OTHER PUBLICATIONS

Jadwin et al, Research Disclosure No. 140, pp. 6–8, Ind. Opportunities Ltd., Homewell, England, 1975.

Patent Abstracts of Japan, vol. 13, No. 157 (P-857)(3505), Apr. 17, 1989 and JP-63-31064.

*Primary Examiner*—Roland Martin

*Attorney, Agent, or Firm*—Fitzpatrick, Cella, Harper & Scinto

[57] ABSTRACT

1. A carrier for electrophotography comprises carrier core particles and a coating resin material. The surfaces of the carrier core particles are each coated with the coating resin material and the coating resin material comprises a resin and a quaternary ammonium salt represented by the following formula:

wherein $R_1$, $R_2$, $R_3$ and $R_4$ each represent an alkyl group, an aryl group or an aralkyl group and $R_1$, $R_2$, $R_3$ and $R_4$ may be the same or different from each other; and A represents an organic anion, an isopolyacid ion or a heteropolyacid ion.

84 Claims, 4 Drawing Sheets

CARRIER FOR ELECTROPHOTOGRAPHY, TWO-COMPONENT TYPE DEVELOPER, PROCESS FOR PRODUCING CARRIER AND IMAGE FORMING METHOD

BACKGROUND OF THE INVENTION

1. Field of the Invention

The present invention relates to a carrier for electrophotography, that composes together with a toner a two-component type developer for developing electrostatic images, and a process for producing the carrier.

The present invention also relates to a two-component type developer for developing electrostatic images, comprised of a toner and a carrier.

The present invention still also relates to an image forming method for developing a latent image by the use of a two-component type developer comprised of a toner and a carrier, under application of a bias voltage in a developing zone.

2. Related Background Art

As conventional electrophotography, various methods are disclosed, for example, in U.S. Pat. No. 2,297,691, Japanese Patent Publication No. 42-23910 (U.S. Pat. No. 3,666,363) and Japanese Patent Publication No. 43-24748 (U.S. Pat. No. 4,071,361). In all of these methods, copies are obtained by irradiating a photoconductive layer with an optical image corresponding with an original to form an electrostatic latent image, subsequently adhering onto the electrostatic latent image a colored fine powder, called a toner, having a polarity opposite to it to develop the electrostatic latent image, and transferring the toner image to a transfer medium such as paper if necessary, followed by fixing by the action of heat, pressure, or solvent vapor.

The step of developing the electrostatic latent image is a step in which toner particles statically charged to a polarity opposite to the latent image is attracted by electrostatic attraction force so as to be adhered onto the electrostatic latent image. (In the case of reversal development, a toner having triboelectric charges with the same polarity as the charges of a latent image is used.) In general, methods of developing such an electrostatic latent image by the use of a toner can be roughly grouped into a method making use of what is called the two-component type developer, comprising a toner dispersed in a small amount in a medium called a carrier, and a method making use of what is called the one-component type developer, comprising a toner alone without use of a carrier.

In general, the carrier that composes such a two-component type developer can be roughly grouped into a conductive carrier and an insulative carrier.

The conductive carrier is usually comprised of oxidized or unoxidized iron powder. A developer composed of this iron powder carrier, however, has the problem that the triboelectric chargeability to a toner is so unstable that fog may be generated on a visible image formed using the developer. More specifically, as the developer is used, toner particles are adhered to the surfaces of the iron powder carrier particles, so that the electrical resistance of carrier particles increases to lower bias currents, and also to make the triboelectric chargeability unstable, resulting in a lowering of the image density of a visible image formed and an increase of fog.

The insulative carrier is commonly typified by a carrier comprising carrier core particles comprised of a ferromagnetic material such as iron, nickel or ferrite whose surfaces are uniformly coated with an insulating resin. A developer that employs this carrier may cause little the fusing of toner particles to the carrier surfaces, compared with the case of the conductive carrier, and hence has the advantage that it is particularly suitable for high-speed electrophotographic copying machines in view of its superior durability and long lifetime.

However, the charges (or the quantity of triboelectricity) of the developer making use of such a carrier coated with an insulating resin commonly tend to change with variations of environmental conditions such as low temperature and low humidity and high temperature and high humidity. As a result, for example, under conditions of low temperature and low humidity a lowering of image density is caused by charge-up, and under conditions of high temperature and high humidity the problems of fog and black spots around images are brought about because of a lowering of triboelectricity.

Thus, under existing circumstances, a carrier having reached a satisfactory level has not been discovered in regard to the carrier coated with an insulating resin.

As to a carrier coated with no insulating resin, various attempts have been made. For example, Japanese Patent Application Laid-open No. 62-229256 discloses a carrier comprising ferrite particles the surfaces of which a water-soluble quaternary ammonium salt is adhered to. Use of the water-soluble quaternary ammonium salt, however, has caused the disadvantage that the quaternary ammonium salt on the ferrite particle surfaces is dissolved out or eliminated after a toner has been left standing for a long period of time under conditions of high temperature and high humidity or after duration for copying (i.e. running), so that the properties of the particles gradually become close to the properties of untreated ferrite particles. In addition, since the particles are not coated with a resin, the quaternary ammonium salt on the ferrite particle surfaces tends to be eliminated not only after running under conditions of high temperature and high humidity but also after that in a normal environment of normal temperature and normal humidity. Even if the quaternary ammonium salt is not eliminated, there has been a problem after all, when compared with the resin-coated carrier, which is the problem that a toner forms a film on the surface of the carrier, i.e., the problem that a toner is so susceptible to the toner-spent phenomenon that a developer has a short lifetime. In addition, unless the particles are coated with a resin having insulating properties up to a certain degree, even in the case of ferrite particles as well as in the case of iron oxide powder, the leak of current occurs in a developing system in which a bias voltage is applied or the adhesion of carrier onto a photosensitive member is great. Thus, in respect of the durability and toner-spent resistance of carriers, no method is presently available which can be superior to the coating of the carrier with an insulating resin.

SUMMARY OF THE INVENTION

An object of the present invention is to provide a carrier that can solve the problems as discussed above, has a superior durability and toner-spent resistance, and at the same time composes a developer having a small variation in charge characteristics and capable of giving a very stable image, against environmental variations (i.e., humidity dependence).

Another object of the present invention is to provide a carrier capable of maintaining for a long period of time the characteristics of less environmental dependence as stated above.

A further object of the present invention is to provide a carrier that has an appropriate resistance and may cause less leak of current or less adhesion of carrier onto a photosensitive member, even when a bias voltage is applied.

A still further object of the present invention is to provide a two-component type developer that can solve the problems as discussed above, has a superior durability and toner-spent resistance, and at the same time has a small environmental variation and is capable of giving a very stable image.

A still further object of the present invention is to provide a process for producing a carrier that composes, together with a toner, a developer that can solve the problems are discussed above, has a superior durability and toner-spent resistance, and at the same time has a small variation in charge characteristics and is capable of giving a very stable image, against environmental variations (i.e., humidity dependence).

A still further object of the present invention is to provide an image forming method that may cause less leak of current or less adhesion of carrier to a photosensitive member, when a latent image is developed under application of a bias voltage at a developing zone.

The above objects of the present invention relating to the carrier can be achieved by a carrier for electrophotography, comprising carrier core particles and a coating resin material, wherein the surfaces of said carrier core particles are each coated with the coating resin material and said coating resin material comprises a resin and a quaternary ammonium salt represented by the following formula:

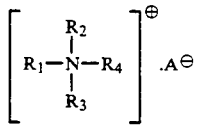

wherein $R_1$, $R_2$, $R_3$ and $R_4$ each represents an alkyl group, an aryl group or an aralkyl group and $R_1$, $R_2$, $R_3$ and $R_4$ may be the same or different from each other; and A represents an organic anion, an isopolyacid ion or a heteropolyacid ion.

The above object of the present invention relating to the two-component type developer can be achieved by a two-component type developer for developing an electrostatic image, comprising a toner and a carrier, wherein said carrier comprises carrier core particles and a coating resin material, the surfaces of said carrier core particles are each coated with the coating resin material, and said coating resin material comprises a resin and a quaternary ammonium salt represented by the following formula:

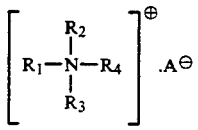

wherein $R_1$, $R_2$, $R_3$ and $R_4$ each represents an alkyl group, an aryl group or an aralkyl group and $R_1$, $R_2$, $R_3$ and $R_4$ may be the same or different from each other; and A represents an organic anion, an isopolyacid ion or a heteropolyacid ion.

The above object of the present invention relating to the process for producing the carrier can be achieved by a process for producing a carrier for electrophotography, comprising the steps of;

preparing a coating solution or coating dispersion in which a coating resin material is dissolved or dispersed; said coating resin material comprising a resin and a quaternary ammonium salt represented by the following formula:

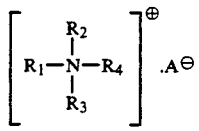

wherein $R_1$, $R_2$, $R_3$ and $R_4$ each represents an alkyl group, an aryl group or an aralkyl group and $R_1$, $R_2$, $R_3$ and $R_4$ may be the same or different from each other; and A represents an organic anion, an isopolyacid ion or a heteropolyacid ion;

coating the surfaces of carrier core particles with the coating solution or coating dispersion thus prepared; and drying the coated carrier core particles to obtain a carrier.

The above object of the present invention relating to the image forming method can be achieved by an image forming method comprising:

developing a latent image by the use of a two-component type developer comprising a toner and a carrier, under application of a bias voltage in a developing zone; wherein said carrier comprises carrier core particles and a coating resin material, the surfaces of said carrier core particles are each coated with the coating resin material and said coating resin material comprises a resin and a quaternary ammonium salt represented by the following formula;

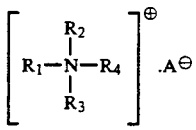

wherein $R_1$, $R_2$, $R_3$ and $R_4$ each represents an alkyl group, an aryl group or an aralkyl group and $R_1$, $R_2$, $R_3$ and $R_4$ may be the same or different from each other; and A represents an organic anion, an isopolyacid ion or a heteropolyacid ion.

DESCRIPTION OF THE PREFERRED EMBODIMENTS

Figure 1:
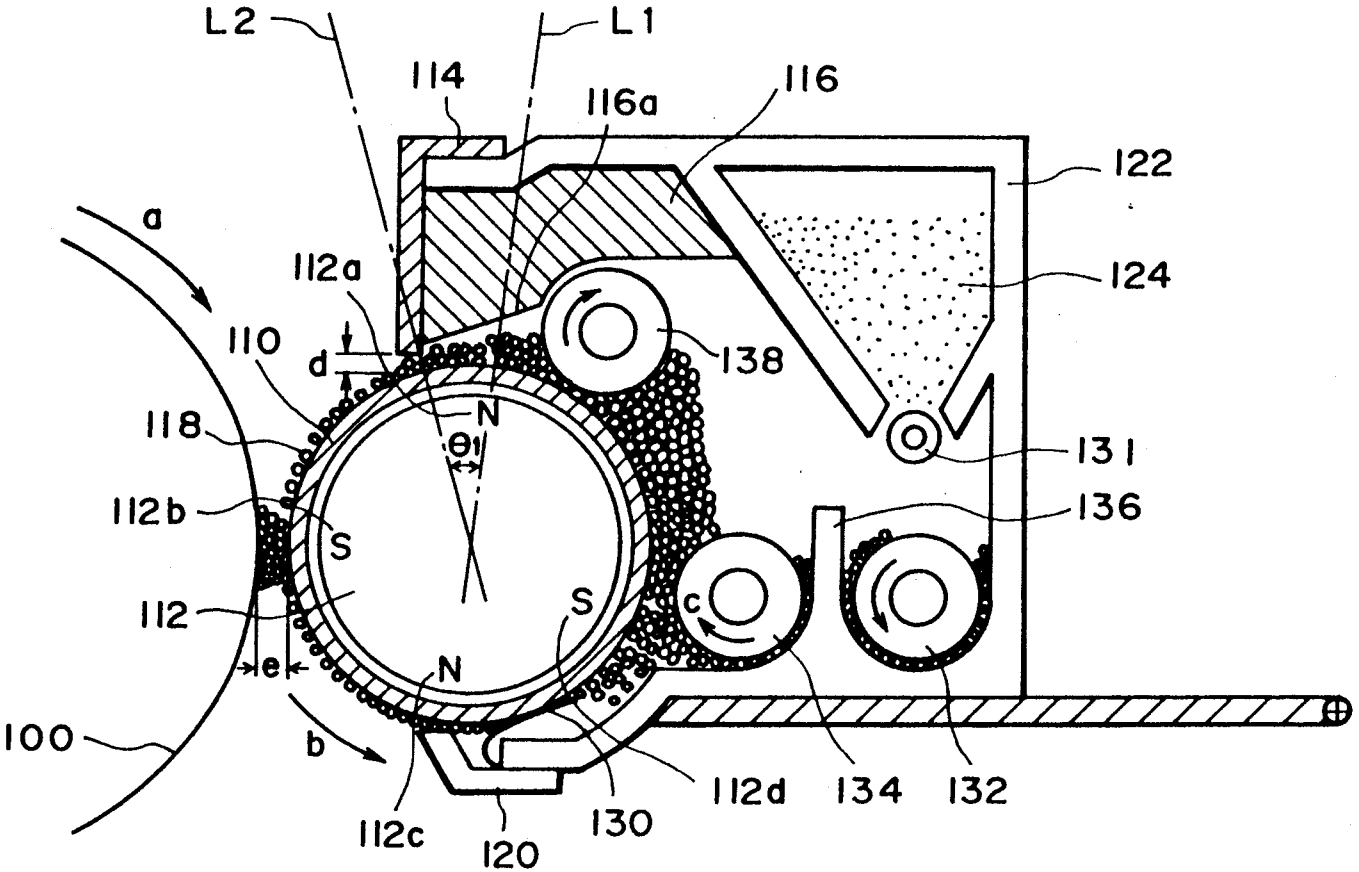
FIG. 1 illustrates an example of the developing apparatus used in the image forming method of the present invention.

Although the mechanism is unclear by which the quaternary ammonium salt used in the present invention improves the environmental stability of a coating resin material coated on carrier core particles, it is presumed that the quaternary ammonium salt of the present invention becomes a leak site to inhibit an insulating coating resin from being electrified under the circumstances of low humidity.

On the other hand, it is considered that since this quaternary ammonium salt is mixed in a coating resin material and the mixture is coated on carrier core particles, the lifetime of the carrier can be made greatly longer, and also that since the quaternary ammonium salt of the present invention comes to the surface of the carrier, the variation of resistance because of environment variations can be suppressed.

The quaternary ammonium salt used in the present invention is in some instances contained in a toner as a positive charge control agent of the toner. The effect obtainable in the present invention, however, can not be exhibited when used in other commonly available positive charge control agents.

The quaternary ammonium salt used in the present invention will be described below.

In the formula:

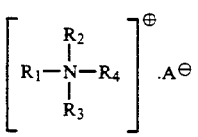

the ion represented by A specifically includes organic sulfate ions, organic sulfonate ions, organic phosphate ions, isopolyacid irons, heteropolyacid ions and carboxylate ions. It preferably includes organic anions, and more preferably aromatic anions. The reason therefor is that the present invention is greatly characterized by the employment of a slightly soluble or insoluble quaternary ammonium salt, and the quaternary ammonium salt slightly soluble in water can be formed when the A is any of the above anions, thus obtaining the properties that no dissolution or elimination occurs under conditions of high humidity. Moreover, since in the present invention this quaternary ammonium salt is mixed in a coating resin material, the quaternary ammonium salt should preferably be slightly soluble in water also in view of the fact that it should be well compatible with the resin in which it is mixed and it should be uniformly mixed.

In the present invention, there are two ways of mixing the quaternary ammonium salt. One of them is a method in which the coating resin material is prepared by dispersing in a solution in which a resin is dissolved or dispersed a quaternary ammonium salt kept in the form of non-soluble particles. The other one is a method in which the coating resin material is prepared by mixing in a solution in which a resin is dissolved or dispersed a quaternary ammonium salt previously dissolved in a solvent.

In the latter method, it is required to select a solvent that can well dissolve the quaternary ammonium salt and is compatible with the solvent in which a resin has been dissolved. Stated specifically, it is required to use a solvent in which the quaternary ammonium salt used in the present invention can be dissolved in a solubility of 1 g/100 g (solvent). Such a solvent includes ketones, amines and alcohols each having a strong polarity. In general, alcohols can be preferably used. Selection thereof, however, can not primarily depend on only the solubility of the quaternary ammonium salt to the solvent. It is also necessary to take account of the compatibility between the resin and the solvent.

It is important for the quaternary ammonium salt used in the present invention to be insoluble or only slightly soluble in water, as previously described. When its degree is defined as the solubility to water on the basis of the weight (g) of the quaternary ammonium salt dissolving in 100 g of water of 20° C., the quaternary ammonium salt used in the present invention has a solubility in water of less than 1.0 g/100 g ($H_2O$, 20° C.), and preferably less than 0.3 g/100 g ($H_2O$, 20° C.).

The solubility referred to in the present invention, of the quaternary ammonium salt in water can be measured by the method described below.

In an Erlenmeyer flask with a ground stopper, 100 g of distilled water and 2.00 g of a quaternary ammonium salt to be dissolved are added, and the flask is hermetically stoppered, which is then shaken for 8 hours in a shaking thermostatic water bath at a temperature of 20°±0.5° C. and at shake of 60 times/min. Thereafter, the shaken mixture is filtered using a filter medium such as filter paper, and $\chi$ g of insoluble matters are weighed. The solubility (quantity) of the quaternary ammonium salt dissolved in 100 g of distilled water is expressed by:

$$2.00-\chi(\text{g}/100\text{ g } H_2O).$$

Next, where the coating resin material is prepared by dissolving the above-described quaternary ammonium salt in a solvent, the following method can be employed as a method of measuring what solubility in a certain solvent a quaternary ammonium salt has.

In an Erlenmeyer flask with a ground stopper, 100 g of a solvent and 50.0 g of a quaternary ammonium salt to be dissolved are added, and the flask is hermetically stoppered, which is then shaken for 8 hours in a shaking thermostatic water bath at a temperature of 20°±0.5° C. and at shake of 60 times/min. Thereafter, the shaken mixture is filtered using a filter medium such as filter paper, and $\chi$ g of insoluble matters are weighed. The solubility (quantity) of the quaternary ammonium salt dissolved in 100 g of a solvent is expressed by:

$$50.0-\chi(\text{g}/100\text{ g solvent}).$$

It is preferred for the quaternary ammonium salt used in the present invention to have a solubility in a solvent of not less than 1.0 g/100 g (solvent), and preferably not less than 5.0 g/100 g (solvent).

The groups represented by $R_1$, $R_2$, $R_3$ and $R_4$ in the formula of the quaternary ammonium salt used in the present invention may preferably include compounds having 1 to 20 carbon atoms, and more preferably compounds having 1 to 18 carbon atoms.

The quaternary ammonium salt that can be used in the present invention can be roughly grouped into two types of a type in which $R_4$ in the formula is an alkyl group and a type in which it is an aryl group or an aralkyl group.

Examples of the quaternary ammonium salt of the type in which $R_4$ is an alkyl group are shown below.

Exemplary Compound 1

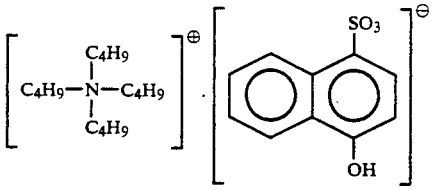

(Solubility in water: less than 0.2 g/100 $H_2O$)

Exemplary Compound 2

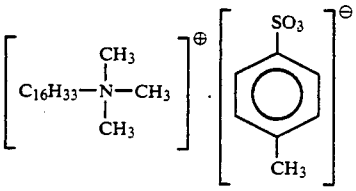

(Solubility in water: less than 0.3 g/100 $H_2O$)

Exemplary Compound 3

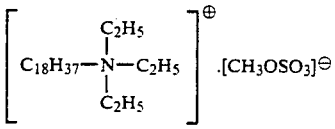

(Solubility in water: less than 0.3 g/100 $H_2O$)

Exemplary Compound 4

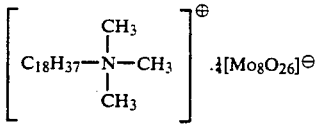

(Solubility in water: less than 0.3 g/100 $H_2O$)

Examples of the quaternary ammonium salt of the type in which $R_4$ is an aryl group or an aralkyl group are shown below.

Exemplary Compound 5

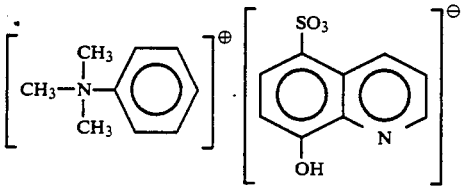

(Solubility in water: less than 0.2 g/100 $H_2O$)

Exemplary Compound 6

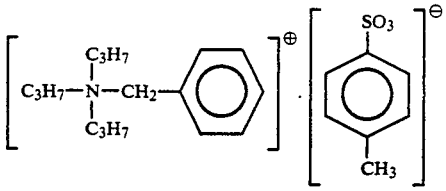

(Solubility in water: less than 0.3 g/100 $H_2O$)

Exemplary Compound 7

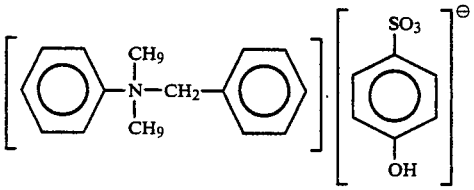

(Solubility in water: less than 0.2 g/100 $H_2O$)

Exemplary Compound 8

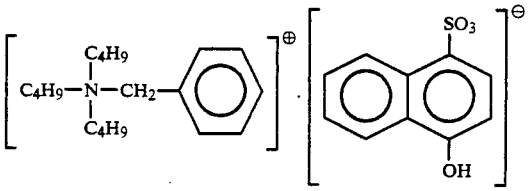

(Solubility in water: less than 0.2 g/100 $H_2O$)

Exemplary Compound 9

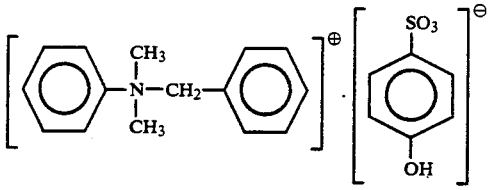

(Solubility in water: less than 0.3 g/100 $H_2O$)

Exemplary Compound 10

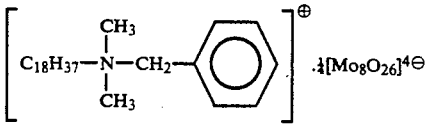

(Solubility in water: less than 0.2 g/100 $H_2O$)

Exemplary Compound 11

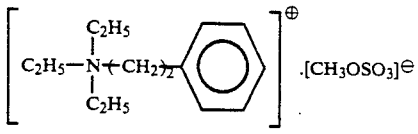

(Solubility in water: less than 0.2 g/100 $H_2O$)

Exemplary Compound 12

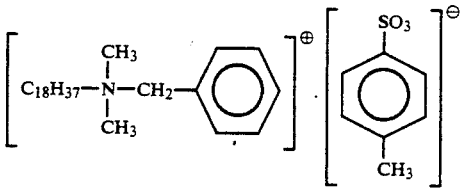

(Solubility in water: less than 0.2 g/100 $H_2O$)

The quaternary ammonium salt used in the present invention includes the lake compounds as shown in Exemplary compounds 4 and 10. These lake compounds can be obtained by treating a usual quaternary ammonium salt with a commonly available lake-forming agent.

The lake-forming agent may include heteropolyacids and isopolyacids as exemplified by tungstophosphoric acid and isopolymolybdic acid.

The quaternary ammonium salt of the present invention may be added in an amount ranging from 0.5 wt. % to 30 wt. %, and preferably ranging from 1.0 wt. % to 20 wt. %, based on the resin. Addition thereof in an amount less than 0.5 can bring about no remarkable effect of making stable the resistance to environmental variations and the quantity of triboelectricity, which effect is characteristic of the present invention. On the other hand, addition thereof in an amount more than 30 wt. % makes non-uniform the coating on carrier core particles.

The coating resin includes a single material or a mixture of resins used in carrier coating.

The coating resin may preferably include vinyl resins. For example, it is possible to use polymers obtained using i) styrene or a styrene derivative such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxylstyrene, p-chlorostyrene, 3,4-dichlorostyrene, m-nitrostyrene, o-nitrostyrene or p-nitrostyrene, and ii) one or more selected from ethylene and unsaturated monoolefins such as ethylene, propylene, butylene and isobutylene; unsaturated diolefins such as butadiene and isoprene; halogenated vinyls such as vinyl chloride, vinylidene chloride, vinyl bromide and vinyl fluoride; vinyl esters such as vinyl acetate, vinyl propionate and vinyl benzoate; methacrylic acid and α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid and acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; maleic acid and maleic half esters; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; acrylic acid or methacrylic acid derivatives such as acrylonitrile, methacrylonitrile and acrylamide; and acroleins.

Acrylic copolymer resins such as styrene-methacrylate copolymers and styrene-acrylate copolymers are preferred on account of their superior durability and long lifetime.

It is effective to copolymerize an acrylic resin containing a hydroxyl group particularly in view of the adhesion to carrier core particles and the action by which the quaternary ammonium salt is made to come to the surface of the carrier.

Monomers of the acrylic resin containing a hydroxyl group include, for example, 2-hydroxyethyl acrylate, 2-hydroxypropyl acrylate, hydroxybutyl acrylate, 2-hydroxy-3-phenyloxypropyl acrylate, 2-hydroxyethyl methacrylate, 2-hydroxypropyl methacrylate, hydroxybutyl methacrylate and 2-hydroxy-3-phenyloxypropyl methacrylate. These monomers may preferably give a hydroxyl number of a copolymer in the range of from 1 to 100 (KOH mg/g).

In the present invention, a carrier core material includes iron powder and ferrite powder, and according to the present invention the carrier core material is coated with the coating resin in such a coating weight that the resin solid content may be in the range of from 0.1 wt. % to 30 wt. %, and preferably in the range of from 0.5 wt. % to 10 wt. %. A coating weight of less than 0.1 wt. % may result in an insufficient effect of coating the carrier core material with the resin. A coating weight more than 30 wt. % is meaningless, and also undesirable from the viewpoint of manufacture because of the possibility that an excess resin is present separately.

It is possible in the present invention to use as the carrier core material all sorts of conventionally commonly known materials such as iron powder and ferrite powder. This is also a significant feature obtainable when the the carrier core material is coated with the coating resin material. The carrier core material used in the present invention may have a particle diameter in the range of from 10 to 1,000 μm, and preferably in the range of from 20 to 200 μm.

In the present invention, the coating resin material can be applied to the carrier core material in the following way: The resin described above is dissolved or suspended in an organic solvent such as toluene, xylene, tetrahydrofuran or ketone. The quaternary ammonium salt of the present invention is further added in a given proportion. These are thoroughly mixed using a mixing machine to prepare a coating resin material solution according to the present invention, which is then coated by a commonly available coating method such as spray coating or fluidized bed coating. Here, as previously described, the quaternary ammonium salt of the present invention can be dispersed in the coating resin material solution by using the method in which the quaternary ammonium salt held in the form of non-soluble particles is dissolved in the coating resin material solution, or the method in which the quaternary ammonium salt is previously dissolved in a solvent arbitrarily selected, which is then mixed with the coating resin material solution, followed by thorough mixing using a mixing machine to make both solutions dissolve together.

The former method is advantageous in that any compounds can be used so long as they are quaternary ammonium salts of the present invention, and can be selected from a vast range of the compounds.

The latter method necessarily requires limitation of the quaternary ammonium salts to those capable of being dissolved in the solvent, giving a narrow range of selection, but is advantageous in the following: Since the quaternary ammonium salt is dissolved, better results can be obtained with its use in a smaller amount, compared with the former method in which it is merely dispersed in the form of non-soluble particles. In addition, the quaternary ammonium salt is presumed to be microscopically dispersed and present in a uniform state, and hence the triboelectric chargeability to a toner in the same opportunity of contact can be more improved than that in the case when the compound is merely dispersed. It therefore becomes possible to quicken the rise of static charge of the toner.

The image forming method according to the present invention will be described below with reference a developing apparatus shown in FIG. 1.

A latent image supporting member 100 is an insulating drum for electrostatic recording or a photosensitive drum or photosensitive belt having a layer comprising a photoconductive insulating material such as $\alpha$-Se, CdS, $ZnO_2$, OPC or $\alpha$-Si. The latent image supporting member 100 is rotated in the direction of arrow a by means of a driving device (not shown). The numeral 110 denotes a developing sleeve serving as a developer carrying member coming into proximity to or contact with the latent image supporting member 100, and is comprised of a non-magnetic material such as aluminum or SUS 316 stainless steel. The developing sleeve 110 is laterally provided in a rotatably supported state on a shaft in such a manner that it is thrust into a developing container 122 by substantially the right half of its periphery, from an oblong opening formed in the longitudinal direction of the container 122 in the wall at its left lower side, and is exposed to the outside of the container by substantially the left half of its periphery. The developing sleeve 110 is rotatively driven in the direction of arrow b.

The numeral 112 denotes a stationary permanent magnet serving as a means for generating stationary magnetic fields, held in alignment at the position and posture as shown in the drawing, and is stationarily held as it is, at the position and posture as shown in the drawing, even when the developing sleeve 110 is rotatively driven. This magnet 112 has four magnetic poles of a north (N) magnetic pole 112*a*, a south (S) magnetic pole 112*b*, a north (N) magnetic pole 112*c* and a south (S) magnetic pole 112*d*. The magnet 112 may be comprised of an electromagnet in place of the permanent magnet.

The numeral 114 denotes a non-magnetic blade serving as a developer control member, provided on, and along the longitudinal direction of, the upper edge of the opening of a developer feeding device at which the developing sleeve 110 is disposed, in such a manner that its base is fixed on the side wall of the container and its tip protrudes to the opening of the container 112 more inside than the position of the upper edge of the opening. The blade is made of, for example, SUS316 stainless steel so worked as to be bent in the L-form in its lateral cross section.

The numeral 116 denotes a magnetic carrier limit control member the front surface of which is brought into contact with the inner surface of the lower side of the non-magnetic blade 114 and the forward bottom surface of which is made to serve as a developer guide surface 116*a*. The part composed of the non-magnetic blade 114, the magnetic carrier limit control member 116 and so forth is a control area.

The numeral 118 denotes the carrier of the present invention comprising ferrite particles (maximum magnetization: 55 to 75 emu/g) coated with resin. The numeral 124 denotes a non-magnetic toner. The numeral 130 denotes a seal member that seals the toner accumulating at the bottom part of the developing container 122. The seal member has an elasticity and is bent in the direction of the rotation of the developing sleeve 110 so that it is elastically pressed against the surface of the developing sleeve 110. This seal member 130 has its end on the downstream side in the direction in which the sleeve is rotated, in the area at which it comes into contact with the sleeve, so as to allow the developer to enter into the inner side of the container.

The numeral 120 denotes a scattering preventive electrode plate that causes a floating developer generated in a developing step to adhere to the photosensitive member side under application of a voltage having the same polarity as the developer so that the developer can be prevented from scattering or flying about.

The numeral 131 denotes a toner feed roller which is operated in accordance with an output obtained from a toner density sensor (not shown). As the sensor, it is possible to utilize a system by which the volume of the developer is detected, an antenna system in which a piezoelectric device, an inductance variation detecting device and an alternating current bias are utilized, or a system by which an optical density is detected. A non-magnetic toner 124 is fed by the rotating/stopping of the roller. A fresh developer fed with the toner 124 is blended and stirred while it is transported by means of a screw 132. Hence, the toner fed is triboelectrically charged in the course of this transportation. The numeral 136 denotes a partition plate, which is cut out at the both ends of its longitudinal direction, and at these cutouts the fresh developer transported by the screw 132 is delivered to a screw 134.

The S magnetic pole 112*d* serves as a transport pole. It enables a recovered developer to be collected into the container after development has been carried out, and also the developer in the container to be transported to the control area.

In the vicinity of the magnetic pole 112*d*, the developer recovered after developing is exchanged for the fresh developer transported by the screw 134 provided in proximity to the sleeve.

The numeral 138 denotes a transport screw, which makes uniform the quantity of the developer in the direction of the developing sleeve axis.

The distance d between the lower end of the non-magnetic blade 114 and the surface of the developing sleeve 110 may be in the range of from 100 to 900 $\mu$m and preferably from 150 to 800 $\mu$m. If this distance is smaller than 100 $\mu$m, the magnetic particles as will be described below tend to cause clogging between them to give an uneven developer layer and also may make it impossible to apply the developer in the quantity necessary for carrying out good development, thus bringing about the disadvantage that only developed images with low density and much unevenness can be obtained. The distance d should preferably be not less than 400 μm in order to prevent non-uniform coating (what is called "blade clogging") caused by unauthorized particles included in the developer. If it is larger than 900 μm, the amount of the developer applied to the developing sleeve 110 may increase to make it impossible to control the developer layer to have a given thickness, so that magnetic particles may adhere to the latent image supporting member 100 in a large quantity and at the same time the circulation of developer and the development control attributable to the developer limit control member 116, as will be described below, may be weakened to bring about the disadvantages that the triboelectricity of toner becomes short and fog tends to occur.

When an imaginary line connecting the center of the developing sleeve 110 with the magnetic pole 112*a* is represented by $L_1$ and an imaginary line connecting the center of the developing sleeve 110 with the tip of the non-magnetic blade 114 serving as a developer limit control member is represented by $L_2$, the angle formed by the imaginary lines $L_1$ and $L_2$ is regarded as $\theta_1$. This angle $\theta_1$ should ranges from $-5°$ to 35°, and preferably from 0° to 25°. In an instance of $\theta_1 < -5°$, a developer thin layer formed by the magnetic force, reflection force, cohesive force, etc. may become sparse and greatly uneven. In an instance of $\theta_1 > 35°$, the coating weight of the developer may increase even by use of the non-magnetic blade, making it difficult to apply a given amount of the developer.

When the sleeve 110 is rotatively driven in the direction of arrow b, this layer comprising magnetic particles moves more slowly at its part apart from the surface of the sleeve because of the balance between a restraint force based on gravity and a transport force acting in the direction of the movement of the sleeve 110. Of course, some of the layer may fall by the influence of gravity.

Accordingly, the positions at which the magnetic poles 112*a* and 112*d* are disposed and the fluidity and magnetic characteristics of the magnetic carrier 118 may be appropriately selected, so that the magnetic particle layer is more transported toward the magnetic pole 112*a* at its part near to the sleeve to form a mobile layer. With movement of this magnetic carrier, the developer is transported to a developing zone as the sleeve is rotated, and used there to carry out development.

At this time, it is preferred that the developer layer on the developing sleeve 110 is made to have a thickness equal to or slightly larger than the distance e of the gap at which the developing sleeve 110 and the latent image supporting member 100 are opposed and an alternating electric field is applied to the gap. This distance e should be in the range of from 50 to 800 μm, and more preferably from 100 to 700 μm.

Application of an alternating electric field or a developing bias obtained by overlapping an alternating electric field and a direct-current electric field facilitates the movement of the toner from the developing sleeve 110 to the latent image supporting member 100, so that images with much better quality can be formed.

The alternating electric field as the above alternating electric field to be applied may preferably be not more than 2,000 Vpp. In the instance where the direct-current electric field is overlapped, the direct-current electric field may preferably be applied so as not to be more than 1,000 V.

A method of measuring the quantity of triboelectricity of the toner to the carrier in the present invention will be described in detail with reference to FIG. 2.

Figure 2:
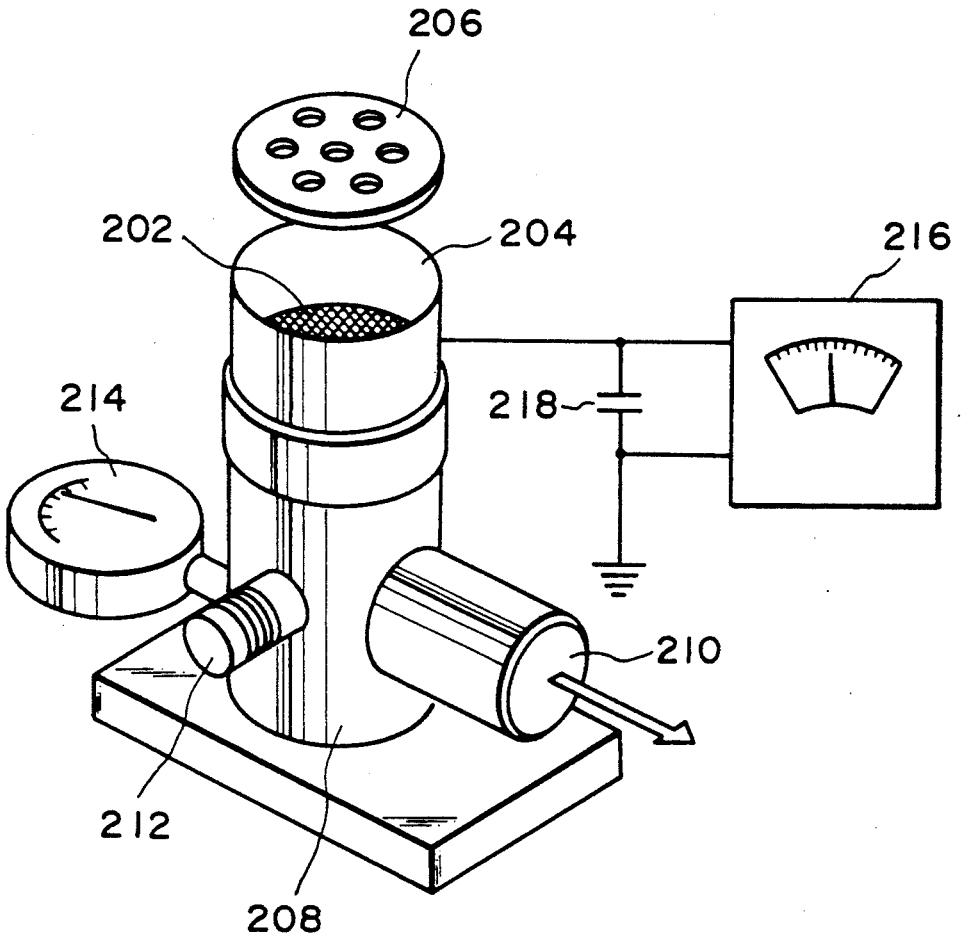
FIG. 2 is a schematic view diagramatically illustrating an apparatus for measuring triboelectric charges of a toner of the two-component type developer for electrophotography according to the present invention.

FIG. 2 illustrates an apparatus for measuring the quantity of triboelectricity. Into a measuring container 204 made of a metal at the bottom of which is provided a conducting screen 202 of 400 meshes (appropriately changeable to the size the screen may not pass the carrier), a developer (a mixture of a toner and the carrier of the present invention) on a developer supporting member are put and the container is covered with a plate 206 made of a metal. The total weight of the measuring container 204 in this state is weighed and is expressed by $W_1$ (g). Next, in a suction device (made of an insulating material at least at the apart coming into contact with the measuring container 204), air is sucked from a suction opening 210 and an air-flow control valve 212 is operated to control the pressure indicated by a vacuum indicator 214 to be 70 mmHg. In this state, suction is sufficiently carried out (for about 1 minute) to remove the toner by suction. The potential indicated by a potentiometer 216 at this time is expressed by V (volt). The numeral 218 denotes a capacitor, whose capacitance is expressed by C (μF). The total weight of the measuring container after completion of the suction is also weighed and is expressed by $W_2$ (g). The quantity Q (μC/g) of triboelectricity is calculated as shown by the following equation.

$$Q(\mu C/g) = \frac{C \times V}{W_1 - W_2}$$

The measurement is carried out under conditions of 23° C. and 65% RH.

As having been described above, in the carrier for electrophotography according to the present invention, the carrier core particles are each coated with the coating resin material containing the quaternary ammonium salt of the present invention. This brings about the following effects.

(1) Charges may undergo only a very slight change due to environmental variations, and hence it is possible to obtain a stable image density.

(2) The effect noted in the above (1) may not be impaired even after running.

(3) The carrier may undergo less deterioration such as a toner-spent phenomenon.

In the two-component type developer for developing electrostatic images according to the present invention, which comprises a toner and a carrier, the carrier is comprised of carrier core particles each coated with the coating resin material containing the quaternary ammonium salt of the present invention. This brings about the following effects.

(1) Charges may undergo only a very slight change due to environmental variations, and hence it is possible to obtain an image with a stable image density.

(2) The effect noted in the above (1) may not be impaired even after running.

(3) The developer may undergo less deterioration of the carrier, such as a toner-spent phenomenon, and hence it is possible to form good images over a long period of time.

In the process for producing the carrier for electrophotography according to the present invention, the coating resin material solution is coated on the carrier core particles. Thus, the carrier for electrophotography according to the present invention can be produced by uniformly dispersing the quaternary ammonium salt in the coating resin material.

In the image forming method of the present invention, latent images are developed under application of a bias voltage in a developing zone, using the two-component type developer comprising a toner and the carrier whose carrier core particles are coated with the coating resin material containing the quaternary ammonium salt. Hence, it is possible to lessen the leak of currents or the adhesion of carrier onto a photosensitive member, and to form good images over a long period of time.

EXAMPLES

The present invention will be described below by giving Examples and with reference to drawings. In the following, "part(s)" refer to "part(s) by weight" in all instances.

EXAMPLE 1

Styrene/2-hydroxyethyl methacrylate/methyl methacrylate copolymer (monomer composition, weight ration: 35:10:55; hydroxyl number (KOH mg/g): 30)

To 100 parts of a 20 wt. % toluene solution of the above styrene copolymer, 1 part of the quaternary ammonium salt as shown in "Exemplary compound 1", kept in the state of particles, was added and these were stirred using a stirrer until they were thoroughly blended. A coating resin material solution was thus prepared.

This coating resin material solution was coated on spherical ferrite particles having an average particle diameter of 45 μm by means of a coater (trade name: Spiracoater; manufactured by Okada Seiko k.K.). The resulting coated carrier was dried at a temperature of 40° C. for 1 hour to remove the solvent, followed by heating at a temperature of 130° C. for 1 hour. A carrier comprising carrier core particles coated with the coating resin material was thus obtained. The resin coating weight of the coated carrier obtained was 0.95 wt. %. Observation using an electron microscope confirmed that the core material of ferrite was uniformely coated with the resin.

Next, a toner was prepared in the following way.

| | |
|---|---|
| Polyester resin obtained by condensation of propoxylated bisphenol with fumaric acid | 100 parts |
| Phthalocyanine pigment | 5 parts |
| Chromium complex salt of di-tert-butylsalicylate | 4 parts |

The above materials were throughly pre-blended using a Henschel mixer, and thereafter the mixture was thereafter melt-kneaded at least twice using a three-roll mill. After cooled, the kneaded product was crushed using a hammer mill to have a particle diameter of about 1 to 2 mm. Subsequently, the crushed product was finely ground using a fine grinding mill of an air-jet system. The finely ground product was further classified to give a cyan color powder (a toner) with a negative triboelectric chargeability, having a volume average particle diameter of 7.2 μm.

Next, 100 parts of the above colored powder (a toner) and 0.5 part of a fine silica powder having been subjected to hydrophobic treatment with hexamethyldisilazane were mixed to give a cyan toner having fine silica powder on the toner particle surfaces.

This cyan toner and the above carrier were left standing for 4 days in an environment of low temperature and low humidity (L/L) (temperature 15° C./humidity 10% RH), an environment of normal temperature and normal humidity (N/N) (temperature 23° C./humidity 60% RH) and an environment of high temperature and high humidity (H/H) (temperature 30° C./humidity 90% RH). Thereafter, these were blended in a toner concentration of 5 wt. %, and the quantities of triboelectricity were measured by the method as shown in FIG. 2.

This coated carrier and the above cyan toner were blended in the N/N environment in a toner concentration of 10 wt. % to produce a developer. Using a full-color laser copier CLC-500, manufactured by Canon Inc., the developing contrast of which was set at 350 V, and image reproduction tests were carried out in the respective environments described above. Results obtained from the above are shown in Table 1, from which it is seen that the developer has a good durability and causes less changes due to environmental variations. Further, in the H/H environment, the above developer was fed in the developing device to carry out running for 6 hours without image-copying. Thereafter, the toner and the carrier were separated. The carrier thus recovered and the fresh cyan toner as described above were blended at a toner concentration of 5 wt. % in the N/N environment, and the quantity of triboelectricity in the N/N environment was measured to reveal that, as shown in Table 1, it was substantially the same as the quantity of triboelectricity obtained when the fresh carrier was used. This recovered carrier was observed with an electron microscope to confirm that any remarkable toner-spent phenomenon or peeling of coated resin was not recognized. In the course of a series of image reproduction tests, the adhesion of the carrier onto the photosensitive member or copy sheets little occurred and images with good image quality were obtained.

Comparative Example 1

Styrene/2-hydroxyethyl methacrylate/methyl methacrylate copolymer (monomer composition, weight ratio: 35:10:55; hydroxyl number (KOH mg/g): 30)

Using a coating resin material solution comprising 100 parts of a 20 wt. % toluene solution of the above styrene copolymer as used in Example 1, the same ferrite particles as in Example 1 were coated in the same manner as in Example 1 to give a carrier whose carrier core particles were coated with the coating resin material. Using this carrier, measurement and tests were carried out in the same manner as in Example 1. Results obtained are shown in Table 1.

As will be seen from the results shown in Table 1, the carrier comprised of the carrier core particles coated with the coating resin material containing no quaternary ammonium salt according to the present invention has a good durability and toner-spent resistance, but causes great variations in the quantity of triboelectricity, resulting in a great difference in image density.

Comparative Example 2

Styrene/2-hydroxyethyl methacrylate/methyl methacrylate copolymer (monomer composition, weight ration: 35:10:55; hydroxyl number (KOH mg/g): 30)

To 100 parts of a 20 wt. % toluene solution of the above styrene copolymer as used in Example 1, 1 part of the quaternary ammonium salt represented by the following formula, kept in the state of particles, was added and a coating resin material solution was prepared in the same manner as in Example 1.

In the step of blending them by stirring, this quaternary ammonium salt was not so uniformly blended as in Example 1, showing a poor compatibility with the resin.

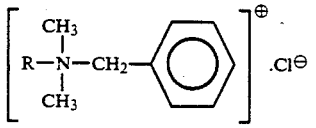

(R represents a $C_{12}$ to $C_{18}$ alkyl group)
Solubility in water: 1.0 g/100 g or more ($H_2O$, 20° C.)

This coating resin material solution was coated in the same manner as in Example 1 on the ferrite particles as used in Example 1 to give a carrier whose carrier core particles were coated with the coating resin material. Using this carrier, tests were carried out in the same manner as in Example 1. As a result, as shown in Table 1, the effect of environmental stability, attributable to the addition of the quaternary ammonium salt, is seen to have been diminished as a result of running.

Figure 3:
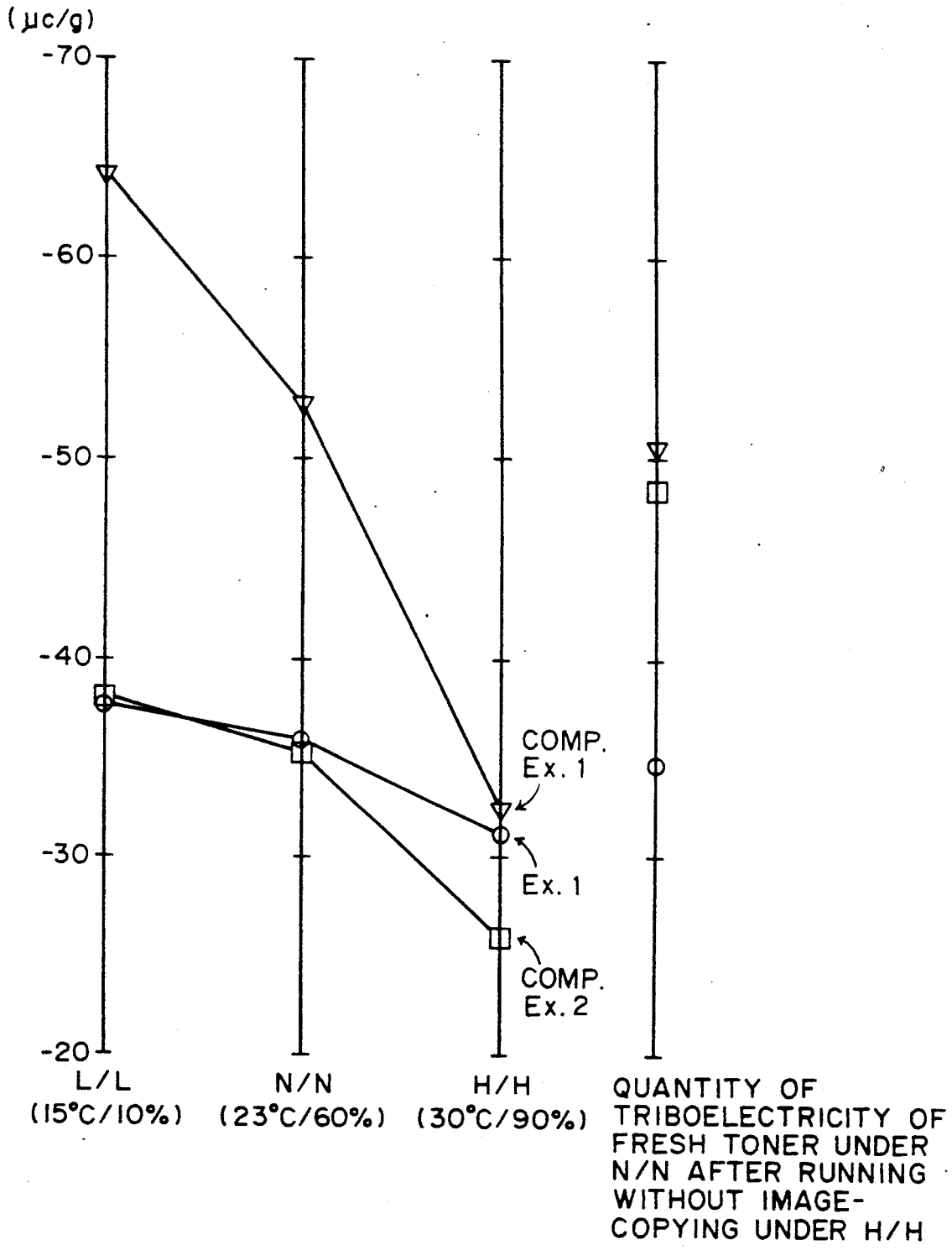
FIGS. 3 and 4 are graphs showing how triboelectric charging characteristics of developers change with environmental changes.

FIG. 3 shows changes in the quantities of triboelectricity in each environment, in respect of the developers of Example 1 and Comparative Examples 1 and 2.

EXAMPLE 2

Styrene/2-hydroxyethyl methacrylate/methyl methacrylate copolymer (monomer composition, weight ratio: 35:10:55; hydroxyl number (KOH mg/g): 30)

To 100 parts of a 20 wt. % toluene solution of the above styrene copolymer, 1 part of the quaternary ammonium salt as shown in "Exemplary compound 1", kept in the state of particles, was added and these were stirred using a stirrer until they were thoroughly blended. A coating resin material solution was thus prepared.

This coating resin material solution was coated on spherical ferrite particles having an average particle diameter of 100 μm by means of a coater (trade name: Spiracoater; manufactured by Okada Seiko k.K.). The resulting coated carrier was dried at a temperature of 40° C. for 1 hour to remove the solvent, followed by heating at a temperature of 130° C. for 1 hour. A carrier comprising carrier core particles coated with the coating resin material was thus obtained. The resin coating weight of the coated carrier obtained was 0.75 wt. %. Observation using an electron microscope confirmed that the core material of ferrite was uniformely coated with the resin.

A toner (containing 100 parts of a binder resin comprising a styrene copolymer and a paraffin, 9 parts of a coloring agent comprising carbon black and 3 parts of a charge control agent comprising a negatively chargeable, metal-containing complex) for a copying machine NP5000, manufactured by Canon Inc., and the above carrier were blended in a toner concentration of 2 wt. %, in an environment of low temperature and low humidity (L/L) (15° C./10% RH), an environment of normal temperature and normal humidity (N/N) (23° C./60% RH) and an environment of high temperature and high humidity (H/H) (30° C./90% RH), and the quantities of triboelectricity were measured by the method as shown in FIG. 2. Next, using the developer prepared in the N/N environment, image reproduction tests were carried out in the above respective environments by the use of a modified machine ($\theta_1$: 16°; d: 800 μm; e: 500 μm; an alternating electric field: 2,000 Hz–2,000 Vpp; direct-current electric field: 550 V) of a copier NP5000, manufactured by Canon Inc.

As a result, as shown in Table 1, good images with high image densities and less influenced by environmental variations were obtained both at the initial stage and after running for 100,000 sheet copying. Further, the above developer was fed in the developing device to carry out running for 6 hours without image-copying in the H/H environment, in the same manner as in Example 1. Thereafter, the toner and the carrier were separated and recovered. The carrier thus recovered and the fresh toner were blended to confirm whether or not the carrier was deteriorated. As a result, as shown in Table 1, there was little change in chargeability, and thus the carrier was seen to have deteriorated only very slightly. This recovered carrier was observed with an electron microscope to confirm that any remarkable toner-spent phenomenon or peeling of coated resin was not recognized.

Moreover, in the course of a series of image reproduction tests, the adhesion of the carrier onto the photosensitive member or copy sheets occurred only very slightly.

Comparative Example 3

The quaternary ammonium salt as used in Comparative Example 2 was dissolved in distilled water to produce a 0.5 wt. % preparatory solution. In this preparatory solution, ferrite particles with an average particle diameter of 100 μm were immersed. These were stirred for 20 minutes, filtered, and thereafter subjected to a drying step at 105° C. for 2 hours to give a carrier. Using the carrier thus obtained and using the same toner as in Example 2, the evaluation was made in the same manner as in Example 2. As a result, as shown in Table 1, good images were obtained without any significant difference between the respective environments at the initial stage before running. With running, however, the image density began to be lowered particularly in the environment of low humidity, and fog tended to occur in the environment of high humidity. After running for 6 hours without image-copying, the quantity of triboelectricity of the recovered carrier changed to −4.2 μC/g, which was lower than the initial value (−7.7 μC/g). This recovered carrier was also observed with an electron microscope to confirm that a partial toner-spent phenomenon was recognized like the case of an uncoated ferrite carrier.

EXAMPLE 3

Styrene/methyl methacrylate/2-ethylhexyl acrylate copolymer (monomer composition, weight ratio: 45:35:20)

To 100 parts of a 10 wt. % xylene solution of the above styrene copolymer, 1 part of the quaternary ammonium salt as shown in "Exemplary compound 12", kept in the state of particles, was added and these were stirred using a stirrer until they were thoroughly blended. A coating resin material solution was thus prepared.

This coating resin material solution was coated on spherical iron powder having an average particle diameter of 100 μm by means of a coater (trade name: Spiracoater; manufactured by Okada Seiko k.K.). The resulting coated carrier was dried at a temperature of 40° C. for 1 hour to remove the solvent, followed by heating at a temperature of 130° C. for 1 hour. A carrier comprising carrier core particles coated with the coating resin material was thus obtained. The resin coating weight of the coated carrier obtained was 1.22 wt. %. Observation using an electron microscope confirmed that the core material of iron powder was uniformely coated with the resin.

A toner (containing 100 parts of a binder resin comprising a styrene copolymer and a paraffin, 9 parts of a coloring agent comprising carbon black and 3 parts of a charge control agent comprising a negatively chargeable, metal-containing complex) for a copying machine NP5000, manufactured by Canon Inc., and the above carrier were blended in a toner concentration of 2 wt. %, in an environment of low temperature and low humidity (L/L) (15° C./10% RH), an environment of normal temperature and normal humidity (N/N) (23° C./60% RH) and an environment of high temperature and high humidity (H/H) (30° C./90% RH), and the quantities of triboelectricity were measured by the method as shown in FIG. 2. Next, using the developer prepared in the N/N environment, image reproduction tests were carried out in the above respective environments by the use of a modified machine ($\theta_1$: 16°; d: 800 μm; e: 500 μm; an alternating electric field: 2,000 Hz–2,000 Vpp; direct-current electric field: 550 V) of a copier NP5000, manufactured by Canon Inc. As a result, as shown in Table 1, good images with high image densities and less influenced by environmental variations were obtained both at the initial stage and after running for 100,000 sheet copying. The above developer was fed in the developing device to carry out running for 6 hours without image-copying in the H/H environment, in the same manner as in Example 1. Thereafter, the toner and the carrier were separated and recovered. The carrier thus recovered and the fresh toner were blended to confirm whether or not the carrier was deteriorated. As a result, as shown in Table 1, there was little change in chargeability, and thus the carrier was seen to have deteriorated only very slightly. This recovered carrier was observed with an electron microscope to confirm that any remarkable toner-spent phenomenon or peeling of coated resin was not recognized.

Moreover, in the course of a series of image reproduction tests, the adhesion of the carrier onto the photosensitive member or copy sheets occurred only very slightly.

Figure 4:
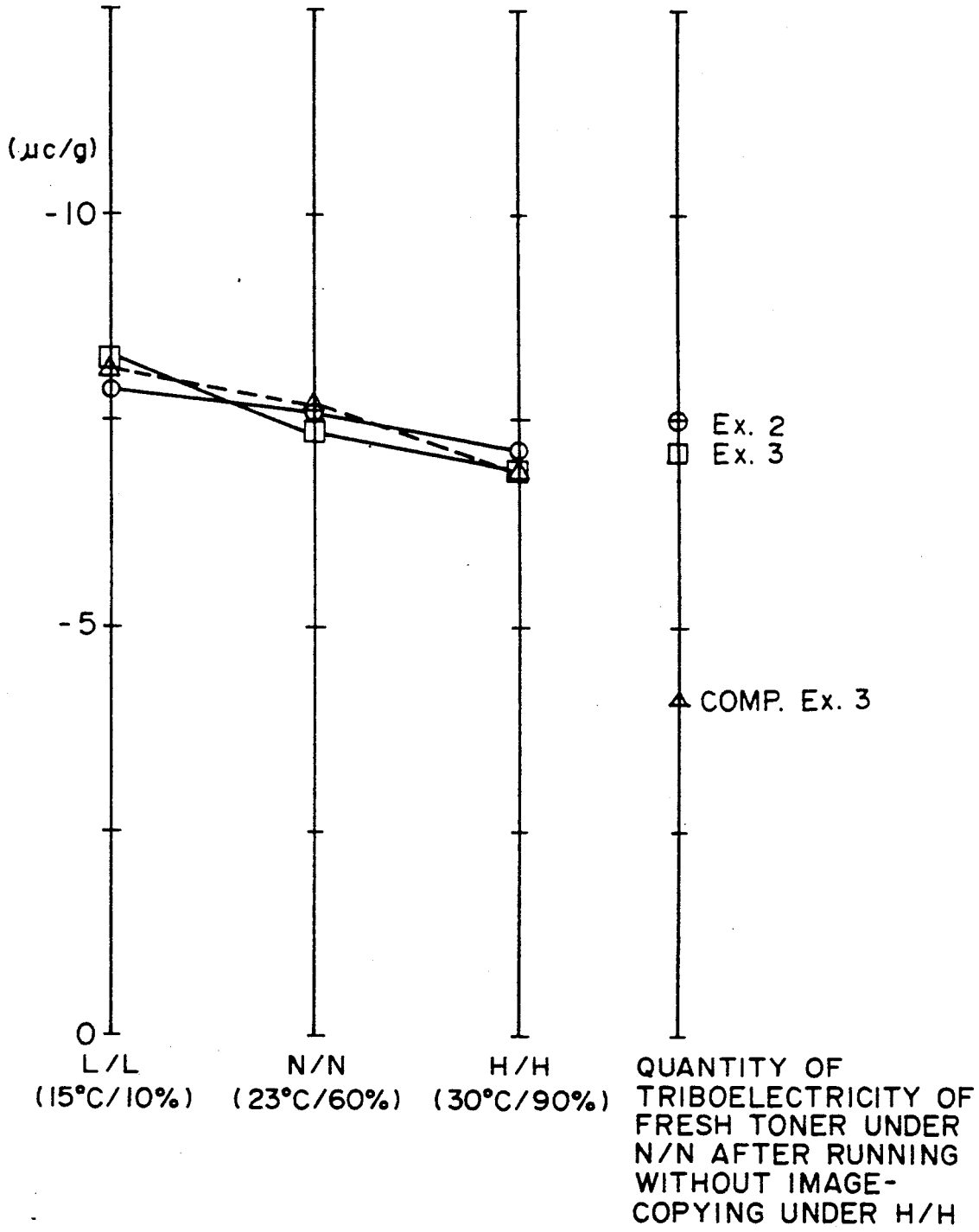

FIG. 4 shows changes in the quantities of triboelectricity in each environment, in respect of the developers of Example 2, Comparative Example 2 and Example 2.

EXAMPLE 4

Styrene/2-hydroxyethyl methacrylate/methyl methacrylate copolymer (monomer composition, weight ratio: 35:8:57; hydroxyl number (KOH mg/g): 30): 5 parts Vinylidene fluoride/tetrafluoroethylene copolymer (monomer composition, weight ratio: 75:25): 5 parts The above copolymers (10 parts in total) were dissolved in 90 parts of a mixed solvent of acetone and methyl ethyl ketone (mixing weight ratio: 1:1). A preparatory solution with a 10 wt. % concentration was thus prepared. To 100 parts of this solution, 0.5 part of the quaternary ammonium salt as shown in "Exemplary compound 1", kept in the state of particles, was added and these were stirred using a stirrer until they were thoroughly blended. A coating resin material solution was thus prepared.

This coating resin material solution was coated on spherical ferrite particles having an average particle diameter of 75 μm by means of a coater (trade name: Spiracoater; manufactured by Okada Seiko k.K.). The resulting coated carrier was dried at a temperature of 40° C. for 1 hour to remove the solvent, followed by heating at a temperature of 130° C. for 1 hour. A carrier comprising carrier core particles coated with the coating resin material was thus obtained. The resin coating weight of the coated carrier obtained was 0.80 wt. %. Observation using an electron microscope confirmed that the core material of ferrite was uniformely coated with the resin.

Next, a toner was prepared in the following way.

| | |
|---|---|
| Styrene/2-ethylhexyl acrylate/dimethylaminoethyl methacrylate copolymer (monomer composition, weight ratio: 80:15:5) | 100 parts |
| Copper phthalocyanine | 4 parts |
| Low-molecular polypropylene | 6 parts |

The above composition was mixed, melt-kneaded, pulverized, and then classified to produce fine cyan resin particles with a volume average particle diameter of 11 μm. In a Henschel mixer, 100 parts of the fine cyan resin particles and 0.8 wt. % of positively chargeable hydrophobic colloidal silica treated with amino-modified silicone oil were blended to prepare a cyan toner.

The above carrier and toner were blended in a toner concentration of 8 wt.%, in an environment of low temperature and low humidity (L/L) (15° C./10% RH), an environment of normal temperature and normal humidity (N/N) (23° C./60% RH) and an environment of high temperature and high humidity (H/H) (30° C./90% RH), and the quantities of triboelectricity were measured by the method as shown in FIG. 2. Next, using the developer prepared in the N/N environment, image reproduction tests were carried out in the above respective environments by the use of a blue-color copying machine NP4835, manufactured by Canon Inc.

As a result, as shown in Table 1, the environmental variations were found to have only a very slight influence. The above developer was fed in the developing device to carry out running for 6 hours without image-copying in the H/H environment, in the same manner as in Example 1. Thereafter, the toner and the carrier were separated and recovered. The carrier thus recovered and the fresh toner were blended to confirm whether or not the carrier was deteriorated. As a result, as shown in Table 1, there was little change in chargeability, and thus the carrier was seen to have deteriorated only very slightly. This recovered carrier was observed with an electron microscope to confirm that any remarkable toner-spent phenomenon or peeling of the coated coating resin material was not recognized.

Moreover, in the course of a series of image reproduction tests, the adhesion of the carrier onto the photosensitive member or copy sheets occurred only very slightly.

TABLE 1

| | Triboelectricity of toner (μC/g) | | | Image density in actual copying: Initial stage | | | Image density in actual copying: After running for 100,000 sheet copying | | | (1) |
|---|---|---|---|---|---|---|---|---|---|---|
| | L/L | N/N | H/H | L/L | N/N | H/H | L/L | N/N | H/H | (μC/g) |
| Example 1 | −37.8 | −36.0 | −31.2 | 1.45 | 1.47 | 1.55 | 1.48 | 1.48 | 1.54 | −34.8 |
| Comparative Example | | | | | | | | | | |
| 1 | −64.1 | −52.7 | −32.5 | 0.94 | 1.18 | 1.49 | 0.98 | 1.20 | 1.50 | −50.3 |
| 2 | −38.1 | −35.4 | −26.0 | 1.44 | 1.49 | 1.60 | 1.08 | 1.23 | 1.50 | −48.5 |
| Example 2 | −7.9 | −7.6 | −7.1 | 1.34 | 1.35 | 1.41 | 1.35 | 1.37 | 1.40 | −7.5 |
| Comparative Example 3 | −8.1 | −7.7 | −6.9 | 1.32 | 1.36 | 1.40 | 1.05 | 1.18 | 1.40 | −4.2 |
| Example | | | | | | | | | | |
| 3 | −8.2 | −7.7 | −6.9 | 1.30 | 1.37 | 1.40 | 1.34 | 1.38 | 1.41 | −7.2 |
| 4 | +17.5 | +17.8 | +17.0 | 1.33 | 1.34 | 1.32 | 1.34 | 1.34 | 1.31 | +17.5 |

(1) Quantity of triboelectricity when carrier after running for 6 hours without image-copying under H/H was separated and blended with fresh toner

EXAMPLE 5

Styrene/2-hydroxyethyl methacrylate/methyl methacrylate copolymer (monomer composition, weight ratio: 35:10:55; hydroxyl number (KOH mg/g): 30)

To 100 parts of a 20 wt. % toluene solution of the above styrene copolymer, 1 part of the quaternary ammonium salt as shown in "Exemplary compound 1", kept in the state of particles, was added and these were stirred using a stirrer until they were thoroughly blended. A coating resin material solution was thus prepared.

This coating resin material solution was coated on spherical ferrite particles having an average particle diameter of 45 μm by means of a coater (trade name: Spiracoater; manufactured by Okada Seiko k.K. ). The resulting coated carrier was dried at a temperature of 60° C. for 1 hour to remove the solvent, followed by heating at a temperature of 140° C. for 1 hour. A carrier comprising carrier core particles coated with the coating resin material was thus obtained. The resin coating weight of the coated carrier obtained was 0.90 wt. %. Observation using an electron microscope confirmed that the core material of ferrite was uniformely coated with the resin.

Next, a toner was prepared in the following way.

| | |
|---|---|
| Polyester resin obtained by condensation of propoxylated bisphenol with fumaric acid | 100 parts |
| Phthalocyanine pigment | 5 parts |
| Chromium complex salt of di-tert-butylsalicylate | 4 parts |

The above materials were thoroughly pre-blended using a Henschel mixer, and the mixture was thereafter melt-kneaded at least twice using a three-roll mill. After cooled, the kneaded product was crushed using a hammer mill to have a particle diameter of about 1 to 2 mm. Subsequently, the crushed product was finely ground using a fine grinding mill of an air-jet system. The finely ground product was further classified to give a cyan color powder (a tone) with a negative triboelectric chargeability, having a volume average particle diameter of 7.2 μm.

Next, 100 parts of the above colored powder (a toner) and 0.5 part of a fine silica powder having been subjected to hydrophobic treatment with hexamethyldisilazane were mixed to give a cyan toner having fine silica powder on the toner particle surfaces. This cyan toner and the above carrier were left standing for 4 days in an environment of low temperature and low humidity (L/L) (temperature 15° C./humidity 10% RH), an environment of normal temperature and normal humidity (N/N) (temperature 23° C./humidity 60% RH) and an environment of high temperature and high humidity (H/H) (temperature 30° C./humidity 90% RH). Thereafter, these were blended in a toner concentration of 5 wt. %, and the quantities of triboelectricity were measured by the method as shown in FIG. 2.

This coated carrier and the above cyan toner were blended in the N/N environment in a toner concentration of 5 wt. % to produce a two-component type developer. Using a commercially available plain paper color copier (CLC-500, manufactured by Canon Inc.), the developing contrast of which was set at 350 V, and image reproduction tests were carried out in the respective environments described above. Results obtained from the above are shown in Table 2, from which it is seen that the developer has a good durability and causes less changes due to environmental variations. Further, in the H/H environment, the above developer was fed in the developing device to carry out running for 6 hours without image-copying. Thereafter, the toner and the carrier were separated. The carrier thus recovered and the fresh cyan toner as described above were blended at a toner concentration of 5 wt. % in the N/N environment, and the quantity of triboelectricity in the N/N environment was measured to reveal that, as shown in Table 2, it was substantially the same as the quantity of triboelectricity obtained when the fresh carrier was used. This recovered carrier was observed with an electron microscope to confirm that any remarkable toner-spent phenomenon or peeling of coated resin was not recognized. In the course of a series of image reproduction tests, the adhesion of the carrier onto the photosensitive member or copy sheets occurred only very slightly and images with good image quality were obtained.

Comparative Example 4

Styrene/2-hydroxyethyl methacrylate/methyl methacrylate copolymer (monomer composition, weight ratio: 35:10:55; hydroxyl number (KOH mg/g): 30)

To 100 parts of a 20 wt. % toluene solution of the above styrene copolymer, 1 part of Nigrosine N-07 (Orient Chemical Industries Ltd.) was added and these were stirred using a stirrer until they were thoroughly blended. A coating resin material solution was thus prepared.

This coating resin material solution was coated on spherical ferrite particles having an average particle diameter of 100 μm by means of a coater (trade name: Spiracoater; manufactured by Okada Seiko k.K.). The resulting coated carrier was dried at a temperature of 60° C. for 1 hour to remove the solvent, followed by heating at a temperature of 140° C. for 1 hour. A carrier comprising carrier core particles coated with the coating resin material was thus obtained. The resin coating weight of the coated carrier obtained was 0.82 wt. %. Observation using an electron microscope confirmed that the core material of ferrite was uniformly coated with the resin.

Using this carrier, the same measurement and tests as in Example 5 were carried out. As a result, as shown in Table 2, the environmental stability of triboelectric charge was not improved by the addition of Nigrosine N-07 as a charge control agent, but the image density was seen to become lower with running. In addition, black fog was seen on images obtained after running, and it was found that the Nigrosine N-07 was eliminated from the surface of the carrier, in the state of which the development was carried out, or it was scattered to cause the deterioration of image quality.

EXAMPLE 6

Using the coating resin material solution prepared in Example 5, the solution was coated on spherical ferrite particles having an average particle diameter of 100 μm by means of a coater (trade name: Spiracoater; manufactured by Okada Seiko k. K.). The resulting coated carrier was dried at a temperature of 60° C. for 1 hour to remove the solvent, followed by heating at a temperature of 140° C. for 1 hour. A carrier comprising carrier core particles coated with the coating resin material was thus obtained. The resin coating weight of the coated carrier obtained was 0.75 wt. %. Observation using an electron microscope confirmed that the core material of ferrite was uniformely coated with the resin.

The above carrier and a toner (containing 100 parts of a binder resin comprising a styrene copolymer and a paraffin, 9 parts of a coloring agent comprising carbon black and 3 parts of a charge control agent comprising a negatively chargeable, metal-containing complex) for a copying machine NP5000, manufactured by Canon Inc., were blended in a toner concentration of 2 wt. %, in an environment of low temperature and low humidity (L/L) (15° C./10% RH), an environment of normal temperature and normal humidity (N/N) (23° C./60% RH) and an environment of high temperature and high humidity (H/H) (30° C./90% RH), and the quantities of triboelectricity were measured by the method as shown in FIG. 2.

Next, using the developer prepared in the N/N environment, image reproduction tests were carried out in the same respective environments as in Example 5 by the use of a modified machine (θ1: 16°; d: 800 μm; e: 500 μm; an alternating electric field: 2,000 Hz-2,000 Vpp; direct-current electric field: 550 V) of a copier NP5000, manufactured by Canon Inc.

As a result, as shown in Table 2, good images with high image densities and less influenced by environmental variations were obtained both at the initial stage and after running for 10,000 sheet copying.

The above developer was fed in the developing device to carry out running for 6 hours without image-copying in the H/H environment, in the same manner as in Example 5. Thereafter, the toner and the carrier were separated and recovered. The carrier thus recovered and the fresh toner were blended to confirm whether or not the carrier was deteriorated. As a result, as shown in Table 2, there was little change in chargeability, and thus the carrier was seen to have deteriorated only very slightly. This recovered carrier was observed with an electron microscope to confirm that any remarkable toner-spent phenomenon or peeling of coated resin was not recognized.

In the course of a series of image reproduction tests, the adhesion of the carrier onto the photosensitive member or copy sheets occurred only very slightly.

EXAMPLE 7

Styrene/methyl methacrylate/2-ethylhexyl acrylate copolymer (monomer composition, weight ratio: 45:35:20)

To 100 parts of a 10wt. % xylene solution of the above styrene copolymer, 0.75 part of the quaternary ammonium salt as shown in "Exemplary compound 2", kept in the state of particles, was added and these were stirred using a stirrer until they were thoroughly blended. A coating resin material solution was thus prepared.

This coating resin material solution was coated on spherical ferrite particles having an average particle diameter of 45 μm by means of a coater (trade name: Spiracoater; manufactured by Okada Seiko k.K.). The resulting coated carrier was dried at a temperature of 60° C. for 1 hour to remove the solvent, followed by heating at a temperature of 140° C. for 1 hour. A carrier comprising carrier core particles coated with the coating resin material was thus obtained. The resin coating weight of the coated carrier obtained was 0.88 wt. %. Observation using an electron microscope confirmed that the core material of ferrite was uniformely coated with the resin.

Next, the cyan toner as used in Example 1 and the above carrier were blended in a toner concentration of 5 wt. %, in an environment of low temperature and low humidity (L/L) (temperature 15° C./humidity 10% RH), an environment of normal temperature and normal humidity (N/N) (temperature 23° C./humidity 60% RH) and an environment of high temperature and high humidity (H/H) (temperature 30° C./humidity 90% RH), and the quantities of triboelectricity were measured by the method as shown in FIG. 2. On the other hand, using a developer containing the toner blended in the N/N environment in a toner concentration of 5 wt. %, image reproduction tests were carried out in the same respective environments as in Example 5, by the use a commercially available plain paper color copier (CLC-500, manufactured by Canon Inc.) whose developing contrast was set at 350 V.

Results obtained from the above are shown in Table 2, from which it is seen that the developer has a good durability and causes less changes due to environmental variations. Further, in the H/H environment, the above developer was fed in the developing device to carry out running for 6 hours without image-copying. Thereafter, the toner and the carrier were separated. The carrier thus recovered and the fresh cyan toner as described above were blended at a toner concentration of 5 wt. % in the N/N environment, and the quantity of triboelectricity in the N/N environment was measured to reveal that, as shown in Table 2, it was substantially the same as the quantity of triboelectricity obtained when the fresh carrier was used. This recovered carrier was observed with an electron microscope to confirm that any remarkable toner-spent phenomenon or peeling of coated resin was not recognized. In the course of a series of image reproduction tests, the adhesion of the carrier onto the photosensitive member or copy sheets occurred only very slightly and images with good image quality were obtained.

EXAMPLE 8

Styrene/2-hydroxyethyl methacrylate/methyl methacrylate copolymer (monomer composition, weight ratio: 35:8:57; hydroxyl number (KOH mg/g): 30): 5 parts Vinylidene fluoride/tetrafluoroethylene copolymer (monomer composition, weight ratio: 75:25): 5 parts The above copolymers (10 parts in total) were dissolved in 90 parts of a mixed solvent of acetone and methyl ethyl ketone (mixing weight ratio: 1:1). A preparatory solution with a 10 wt. % concentration was thus prepared. To 100 parts of this solution, 0.5 part of the quaternary ammonium salt as shown in "Exemplary compound 1", kept in the state of particles, was added and these were stirred using a stirrer until they were thoroughly blended. A coating resin material solution was thus prepared.

This coating resin material solution was coated on spherical ferrite particles having an average particle diameter of 75 μm by means of a coater (trade name: Spiracoater; manufactured by Okada Seiko k.K.). The resulting coated carrier was dried at a temperature of 60° C. for 1 hour to remove the solvent, followed by heating at a temperature of 140° C. for 1 hour. A carrier comprising carrier core particles coated with the coating resin material was thus obtained. The resin coating weight of the coated carrier obtained was 1.02 wt. %. Observation using an electron microscope confirmed that the core material of ferrite was uniformely coated with the coating resin material.

Next, a toner was prepared in the following way.

| | |
|---|---|
| Styrene/2-ethylhexyl acrylate/dimethylaminoethyl methacrylate copolymer (monomer composition, weight ratio: 80:15:5) | 100 parts |
| Copper phthalocyanine | 4 parts |
| Low-molecular weight polypropylene | 6 parts |

The above composition was mixed, melt-kneaded, pulverized, and then classified to produce fine cyan resin particles with a volume average particle diameter of 11 μm. In a Henschel mixer, 100 parts of the fine cyan resin particles and 0.8 wt. % of positively chargeable hydrophobic colloidal silica treated with amino-modified silicone oil were blended to prepare a cyan toner.

The above carrier and the above cyan toner were blended in the same environments as in Example 5 in a toner concentration of 8 wt. %, and the quantities of triboelectricity were measured by the method as shown in FIG. 2. Next, using the developer prepared in the N/N environment, image reproduction tests were carried out in the above respective environments by the use of a blue-color copying machine NP4835, manufactured by Canon Inc. As a result, as shown in Table 2, the environmental variations were found to have only a very slight influence. The above developer was fed in the developing device to carry out running for 6 hours without image-copying in the H/H environment, in the same manner as in Example 5. Thereafter, the toner and the carrier were separated and recovered. The carrier thus recovered and the fresh toner were blended to confirm whether or not the carrier was deteriorated. There was little change in chargeability, and thus the carrier was seen to have deteriorated only very slightly. This recovered carrier was observed with an electron microscope to confirm that any remarkable toner-spent phenomenon or peeling of the coated coating resin material was not recognized.

Moreover, in the course of a series of image reproduction tests, the adhesion of the carrier onto the photosensitive member or copy sheets occurred only very slightly.

TABLE 2

| | Triboelectricity of toner (μC/g) | | | Image density in actual copying: Initial stage | | | Image density in actual copying: After running for 10,000 sheet copying | | | (1) |
|---|---|---|---|---|---|---|---|---|---|---|
| | L/L | N/N | H/H | L/L | N/N | H/H | L/L | N/N | H/H | (μC/g) |
| Example 5 | −37.3 | −36.7 | −31.6 | 1.41 | 1.50 | 1.54 | 1.45 | 1.48 | 1.58 | −34.5 |
| Comparative Example 4 | −65.1 | −35.8 | −19.9 | 1.12 | 1.54 | 1.70 | 0.93 | 1.51 | 1.63 | −31.0 |
| Example | | | | | | | | | | |
| 6 | −7.8 | −7.5 | −7.0 | 1.32 | 1.35 | 1.42 | 1.33 | 1.34 | 1.36 | −7.5 |
| 7 | −36.1 | −35.2 | −34.0 | 1.51 | 1.54 | 1.57 | 1.56 | 1.57 | 1.61 | −34.4 |
| 8 | +16.8 | +17.5 | +16.3 | 1.35 | 1.30 | 1.35 | 1.34 | 1.34 | 1.31 | +17.0 |

(1) Quantity of triboelectricity when carrier after running for 6 hours without image-copying under H/H was separated and blended with fresh toner

EXAMPLE 9

Styrene/2-ethylhexyl methacrylate/methyl methacrylate copolymer (monomer composition, weight ratio: 35:10:55)

First, 100 parts of a 20 wt. % toluene solution of the above styrene copolymer and 20 parts of a 1.0 wt. % ethanol solution of a quaternary ammonium salt in which the quaternary ammonium salt as shown in "Exemplary compound 8" was dissolved (solubilityin ethanol: not less than 1.0 g/100 g.ethanol) were stirred using a stirrer until they were thoroughly blended. A coating resin material solution was thus prepared.

This coating resin material solution was coated on spherical ferrite particles having an average particle diameter of 45 μm by means of a coater (trade name: Spiracoater; manufactured by Okada Seiko k.K.). The resulting coated carrier was dried at a temperature of 60° C. for 1 hour to remove the solvent, followed by heating at a temperature of 140° C. for 1 hour. A carrier comprising carrier core particles coated with the coating resin material was thus obtained. The resin coating weight of the coated carrier obtained was 0.92 wt. %. Observation using an electron microscope confirmed that the core material of ferrite was uniformely coated with the resin.

Next, a toner was prepared in the following way.

| | |
|---|---|
| Polyester resin obtained by condensation of propoxylated bisphenol with fumaric acid | 100 parts |
| Phthalocyanine pigment | 5 parts |
| Chromium complex salt of di-tert-butylsalicylate | 4 parts |

The above materials were thoroughly pre-blended using a Henschel mixer, and the mixture was thereafter melt-kneaded at least twice using a three-roll mill. After cooled, the kneaded product was crushed using a hammer mill to have a particle diameter of about 1 to 2 mm. Subsequently, the crushed product was finely ground using a fine grinding mill of an air-jet system. The finely ground product was further classified to give a cyan color powder (a toner) with a negative triboelectric chargeability, having a volume average particle diameter of 7.3 μm.

Next, 100 parts of the above colored powder (a toner) and 0.5 part of a fine silica powder having been subjected to hydrophobic treatment with hexamethyldisilazane were mixed to give a cyan toner having fine silica powder on the toner particle surfaces. This cyan toner and the carrier described above were left standing for 4 days in an environment of low temperature and low humidity (L/L) (15° C./10% RH), an environment of normal temperature and normal humidity (N/N) (23° C./60% RH) and an environment of high temperature and high humidity (H/H) (30° C./90% RH). Thereafter, these were blended in a toner concentration of 5 wt. %, and the quantities of triboelectricity were measured by the method as shown in FIG. 2.

This coated carrier and the above cyan toner were blended in the N/N environment in a toner concentration of 5 wt. % to produce a two-component type developer. Using a commercially available plain paper copying machine CLC-500, manufactured by Canon Inc., the developing contrast of which was set at 350 V, image reproduction tests were carried out in the respective environments described above. Results obtained from the above are shown in Table 3, from which it is seen that the developer has a good durability and causes less changes due to environmental variations. In the H/H environment, the above developer was fed in the developing device to carry out running for 6 hours without image-copying. Thereafter, the toner and the carrier were separated. The carrier thus recovered and the fresh cyan toner as described above were blended at a toner concentration of 5 wt. % in the N/N environment, and the quantity of triboelectricity in the N/N environment was measured to reveal that, as shown in Table 3, it was substantially the same as the quantity of triboelectricity obtained when the fresh carrier was used. This recovered carrier was observed with an electron microscope to confirm that any remarkable toner-spent phenomenon or peeling of coated resin was not recognized. In the course of a series of image reproduction tests, the adhesion of the carrier onto the photosensitive member or copy sheets little occurred and images with good image quality were obtained.

Comparative Example 5

Styrene/2-ethylhexyl methacrylate/methyl methacrylate copolymer (monomer composition, weight ratio: 35:10:55)

Using only a 20 wt. % toluene solution of the above styrene copolymer, the same ferrite particles as in Example 9 were coated in the same manner as in Example 9 to give a carrier whose carrier core particles were coated with the coating resin material. Using this carrier, measurement and tests were carried out in the same manner as in Example 9. Results obtained are shown in Table 3.

As will be seen from the results shown in Table 5, the carrier comprised of the carrier core particles coated with the coating resin material containing no quaternary ammonium salt according to the present invention has a good durability and toner-spent resistance, but causes great variations in the quantity of triboelectricity in dependence on environmental variations, resulting in a great difference in image density.

Comparative Example 6

Styrene/2-ethylhexyl methacrylate/methyl methacrylate copolymer (monomer composition, weight ratio: 35:10:55)

In 100 parts of a 20 wt. % toluene solution of the above styrene copolymer as used in Example 9, 20 parts of a 1.0 wt. % ethanol solution of a quaternary ammonium salt in which the quaternary ammonium salt represented by the following formula was dissolved (solubility in ethanol: not less than 1 g/100 g) was mixed, and a coating resin material solution was prepared in the same manner as in Example 9.

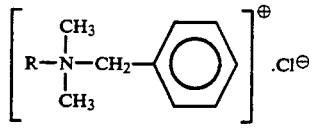

(R represents a $C_{12}$ to $C_{18}$ alkyl group)
Solubility in water: 1.0 g/100 g or more ($H_2O$, 20° C.)

This coating resin material solution was coated in the same manner as in Example 9 on the ferrite particles as used in Example 9 to give a carrier the carrier core particles of which were coated with the coating resin material. Using this carrier, measurement and tests were carried out in the same manner as in Example 9. As a result, as shown in Table 3, the effect of environmental stability, attributable to the addition of the quaternary ammonium salt, is seen to have been diminished as a result of running.

EXAMPLE 10

Styrene/2-ethylhexyl methacrylate/methyl methacrylate copolymer (monomer composition, weight ratio: 35:10:55)

First, 100 parts of a 20 wt. % toluene solution of the above styrene copolymer and 20 parts of a 1.0 wt. % methanol solution of a quaternary ammonium salt in which the quaternary ammonium salt as shown in "Exemplary compound 6" was dissolved (solubility: not less than 1.0 g/100 g.ethanol) were stirred using a stirrer until they were thoroughly blended. A coating resin material solution was thus prepared.

This coating resin material solution was coated on spherical ferrite particles having an average particle diameter of 100 μm by means of a coater (trade name: Spiracoater; manufactured by Okada Seiko k.K.). The resulting coated carrier was dried at a temperature of 60° C. for 1 hour to remove the solvent, followed by heating at a temperature of 130° C. for 1 hour. A carrier comprising carrier core particles coated with the coating resin material was thus obtained. The resin coating weight of the coated carrier obtained was 0.83 wt. %. Observation using an electron microscope confirmed that the core material of ferrite was uniformely coated with the insulating resin.

The resulting carrier and a toner (containing 100 parts of a binder resin comprising a styrene copolymer and a paraffin, 9 parts of a coloring agent comprising carbon black and 3 parts of a charge control agent comprising a negatively chargeable, metal-containing complex) for a copying machine NP5000, manufactured by Canon Inc., were left standing for 4 days in an environment of low temperature and low humidity (L/L) (15° C./10% RH), an environment of normal temperature and normal humidity (N/N) (23° C./60% RH) and an environment of high temperature and high humidity (H/H) (30° C./90% RH). Thereafter, these were blended in a toner concentration of 2 wt. %, in the above respective environments, and the quantities of triboelectricity were measured by the method as shown in FIG. 2.

Next, using the developer prepared in the N/N environment, image reproduction tests were carried out in the above respective environments by the use of a modified machine ($\theta_1$: 16°; d: 800 μm; e: 500 μm; an alternating electric field: 2,000 Hz–2,000 Vpp; direct-current electric field: 550 V) of a copier NP5000, manufactured by Canon Inc.

As a result, as shown in Table 3, good images with high image densities and less influenced by environmental variations were obtained both at the initial stage and after running for 10,000 sheet copying. Further, the above developer was fed in the developing device to carry out running for 6 hours without image-copying in the H/H environment, in the same manner as in Example 9. Thereafter, the toner and the carrier were separated and recovered. The carrier thus recovered and the fresh toner were blended to confirm whether or not the carrier was deteriorated. As a result, as shown in Table 3, there was little change in chargeability, and thus the carrier was seen to have deteriorated only very slightly. This recovered carrier was observed with an electron microscope to confirm that any remarkable toner-spent phenomenon or peeling of coated resin was not recognized.

Moreover, in the course of a series of image reproduction tests, the adhesion of the carrier onto the photosensitive member or copy sheets occurred only very slightly.

Comparative Example 7

The quaternary ammonium salt as used in Comparative Example 9 was dissolved in distilled water to produce a 0.5 wt. % preparatory solution. In this preparatory solution, ferrite particles with an average particle diameter of 100 μm were immersed. These were stirred for 20 minutes, filtered, and thereafter subjected to a drying step at 105° C. for 2 hours to give a carrier. Using the carrier thus obtained and using the same toner as in Example 9, the evaluation was made in the same manner as in Example 9. As a result, as shown in Table 3, good images were obtained without any significant difference between the respective environments at the initial stage before running. With running, however, the image density began to be lowered particularly in the environment of low humidity, and fog tended to occur in the environment of high humidity.

After running for 6 hours without image-copying, the quantity of triboelectricity of the recovered carrier changed to −3.7 μC/g, which was lower than the initial value (−7.5 μC/g). This recovered carrier was also observed with an electron microscope to confirm that a partial toner-spent phenomenon was recognized like the case of an uncoated ferrite carrier.

EXAMPLE 11

Styrene/2-ethylhexyl acrylate/methyl methacrylate copolymer (monomer composition, weight ratio: 45:20:35)

First, 100 parts of a 10 wt. % xylene solution of the above styrene copolymer and 10 parts of a 0.5 wt. % methanol solution of a quaternary ammonium salt in which the quaternary ammonium salt as shown in "Exemplary compound 1" was dissolved solubility in methanol: not less than 1.0 g/100 g) were stirred using a stirrer until they were thoroughly blended. A coating resin material solution was thus prepared.

This coating resin material solution was coated on spherical iron powder having an average particle diameter of 100 μm by means of a coater (trade name: Spiracoater; manufactured by Okada Seiko k.K.).

The resulting coated carrier was dried at a temperature of 60° C. for 1 hour to remove the solvent, followed by heating at a temperature of 140° C. for 1 hour. A carrier comprising carrier core particles coated with the coating resin material was thus obtained. The resin coating weight of the coated carrier obtained was 1.18 wt. %. Observation using an electron microscope confirmed that the carrier core material of iron powder was uniformely coated with the resin.

This carrier and a toner (containing 100 parts of a binder resin comprising a styrene copolymer and a paraffin, 9 parts of a coloring agent comprising carbon black and 3 parts of a charge control agent comprising a negatively chargeable metal-containing complex) for a copying machine NP5000, manufactured by Canon Inc., were left staning for 4 days in an environment of low temperature and low humidity (L/L) (15° C./10% RH), an environment of normal temperature and normal humidity (N/N) (23° C./60% RH) and an environment of high temperature and high humidity (H/H) (30° C./90% RH). Thereafter, these were blended in a toner concentration of 2 wt. %, in the above respective environments, and the quantities of triboelectricity were measured by the method as shown in FIG. 2.

Next, using the developer prepared in the N/N environment, image reproduction tests were carried out in the above respective environments by the use of a modified machine of a copier NP5000, manufactured by Canon Inc., which was so modified as to be suitable for the carrier comprising iron powder particles coated with the resin. As a result, as shown in Table 3, good images with high image densities and less influenced by environmental variations were obtained both at the initial stage and after running for 10,000 sheet copying.

The above developer was fed in the developing device to carry out running for 6 hours without image-copying in the H/H environment, in the same manner as in Example 9. Thereafter, the toner and the carrier were separated and recovered. The carrier thus recovered and the fresh toner were blended to confirm whether or not the carrier was deteriorated. As a result, as shown in Table 3, there was little change in chargeability, and thus the carrier was seen to have deteriorated only very slightly. This recovered carrier was observed with an electron microscope to confirm that any remarkable toner-spent phenomenon or peeling of coated resin was not recognized.

Moreover, in the course of a series of image reproduction tests, the adhesion of the carrier onto the photosensitive member or copy sheets occurred only very slightly.

EXAMPLE 12

Styrene/2-ethylhexyl methacrylate/methyl methacrylate copolymer (monomer composition, weight ratio: 35:7:58)

First, 100 parts of a 10 wt. % xylene solution of the above styrene copolymer and 10 parts of a 0.5 wt. % ethanol solution of a quaternary ammonium salt in which the quaternary ammonium salt as shown in "Exemplary compound 8" was dissolved (solubility: not less than 1.0 g/100 g ethanol) were stirred using a stirrer until they were thoroughly blended. A coating resin material solution was thus prepared.

This coating resin material solution was coated on spherical ferrite particles having an average particle diameter of 70 μm by means of a coater (trade name: Spiracoater; manufactured by Okada Seiko k.K.). The resulting coated carrier was dried at a temperature of 60° C. for 1 hour to remove the solvent, followed by heating at a temperature of 140° C. for 1 hour. A carrier comprising carrier core particles coated with the coating resin material was thus obtained. The resin coating weight of the coated carrier obtained was 1.0 wt. %. Observation using an electron microscope confirmed that the core material of ferrite was uniformely coated with the resin.

Next, a toner was prepared in the following way.

| | |
|---|---|
| Styrene/2-ethylhexyl acrylate/dimethylaminoethyl methacrylate copolymer (monomer composition, weight ratio: 80:15:5) | 100 parts |
| Copper phthalocyanine | 4 parts |
| Low-molecular weight polypropylene | 6 parts |

The above composition was mixed, melt-kneaded, pulverized, and then classified to produce fine cyan resin particles with a volume average particle diameter of 11 μm. In a Henschel mixer, 100 parts of the fine cyan resin particles and 0.8 wt. % of positively chargeable hydrophobic colloidal silica treated with amino-modified silicone oil were blended to prepare a cyan toner.

The above carrier and toner were left standing for 4 days in an environment of low temperature and low humidity (L/L) (15° C./10% RH), an environment of normal temperature and normal humidity (N/N) (23° C./60% RH) and an environment of high temperature and high humidity (H/H) (30° C./90% RH). Thereafter, these were blended in the above respective environments in a toner concentration of 8 wt. %, and the quantities of triboelectricity were measured by the method as shown in FIG. 2.

Next, using the developer prepared in the N/N environment, image reproduction tests were carried out in the above respective environments by the use of a blue-color copying machine NP4835, manufactured by Canon Inc. As a result, as shown in Table 3, the environmental variations were found to have only a very slight influence.

The above developer was fed in the developing device to carry out running for 6 hours without image-copying in the H/H environment, in the same manner as in Example 9. Thereafter, the toner and the carrier were separated and recovered. The carrier thus recovered and the fresh toner were blended to confirm whether or not the carrier was deteriorated. As a result, as shown in Table 3, there was little change in chargeability, and thus the carrier was seen to have deteriorated only very slightly. This recovered carrier was observed with an electron microscope to confirm that any remarkable toner-spent phenomenon or peeling of the coating resin material was not recognized.

Moreover, in the course of a series of image reproduction tests, the adhesion of the carrier onto the photosensitive member or copy sheets occurred only very slightly.

TABLE 3

| | Triboelectricity of toner (μC/g) | | | Image density in actual copying: Initial stage | | | After running for 10,000 sheet copying | | | (1) |
|---|---|---|---|---|---|---|---|---|---|---|
| | L/L | N/N | H/H | L/L | N/N | H/H | L/L | N/N | H/H | (μC/g) |
| Example 9 | −29.5 | −26.4 | −22.7 | 1.46 | 1.48 | 1.53 | 1.48 | 1.51 | 1.57 | −26.0 |
| Comparative Example | | | | | | | | | | |
| 5 | −60.2 | −47.0 | −27.8 | 1.02 | 1.10 | 1.47 | 1.07 | 1.13 | 1.50 | −45.6 |
| 6 | −30.1 | −27.3 | −15.6 | 1.42 | 1.48 | 1.61 | 1.11 | 1.22 | 1.52 | −46.1 |
| Example 10 | −8.1 | −7.7 | −7.2 | 1.33 | 1.36 | 1.41 | 1.35 | 1.38 | 1.40 | −7.6 |
| Comparative Example 7 | −8.4 | −8.2 | −7.5 | 1.30 | 1.35 | 1.38 | 1.09 | 1.12 | 1.43 | −3.7 |
| Example | | | | | | | | | | |
| 11 | −8.5 | −8.4 | −8.0 | 1.29 | 1.30 | 1.34 | 1.30 | 1.31 | 1.30 | −8.2 |

TABLE 3-continued

| | Triboelectricity of toner (μC/g) | | | Image density in actual copying: Initial stage | | | After running for 10,000 sheet copying | | | (1) |
|---|---|---|---|---|---|---|---|---|---|---|
| | L/L | N/N | H/H | L/L | N/N | H/H | L/L | N/N | H/H | (μC/g) |
| 12 | +17.2 | +17.0 | +16.5 | 1.33 | 1.32 | 1.29 | 1.34 | 1.32 | 1.27 | +16.8 |

(1) Quantity of triboelectricity when carrier after running for 6 hours without image-copying under H/H was separated and blended with fresh toner

We claim:

1. A carrier for electrophotography, comprising carrier core particles and a coating resin material, wherein the surfaces of said carrier core particles are each coated with the coating resin material and said coating resin material comprises a resin having an hydroxyl number of 1 to 100 (KOH mg/g) and a quaternary ammonium salt represented by the following formula:

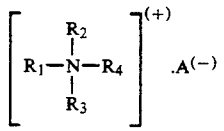

wherein $R_1$, $R_2$, $R_3$ and $R_4$ each are an alkyl group, an aryl group or an aralkyl group and $R_1$, $R_2$, $R_3$ and $R_4$ may be the same or different from each other; and A is an organic anion, an isopolyacid ion or a heteropolyacid ion.

2. A carrier according to claim 1, wherein said quaternary ammonium salt is a lake compound.

3. A carrier according to claim 1, wherein $R_4$ is an aryl group or an aralkyl group.

4. A carrier according to claim 1, wherein $R_1$, $R_2$ and $R_3$ are an alkyl group or an aryl group; and $R_4$ is a group represented by the following formula:

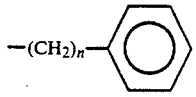

wherein n is an integer of 0, 1, 2 or 3.

5. A carrier according to claim 3, wherein the A in the formula of said quaternary ammonium salt represents an organic anion.

6. A carrier according to claim 5, wherein said organic anion is an aromatic anion.

7. A carrier according to claim 3, wherein said quaternary ammonium salt has a solubility to water of less than 1.0 g/100 g ($H_2O$, 20° C.).

8. A carrier according to claim 3, wherein said quaternary ammonium salt is added in an amount ranging from 0.5% by weight to 30% by weight based on said resin.

9. A carrier according to claim 3, wherein said resin comprises a vinyl resin.

10. A carrier according to claim 9, wherein said vinyl resin comprises an acrylic copolymer resin.

11. A carrier according to claim 10, wherein said acrylic copolymer resin comprises a styrene/2-hydroxyethyl methacrylate/methyl methacrylate copolymer.

12. A carrier according to claim 3, wherein the carrier core particles are coated with said coating resin material in a coating weight that provides a resin solid content ranging from 0.1% by weight to 30% by weight.

13. A carrier according to claim 3, wherein said carrier has a particle diameter ranging from 10 to 1,000 μm.

14. A carrier according to claim 1, wherein $R_4$ represents an alkyl group.

15. A carrier according to claim 1, wherein $R_1$, $R_2$, $R_3$ and $R_4$ each represents an alkyl group.

16. A carrier according to claim 14, wherein the A in the formula of said quaternary ammonium salt represents an organic anion.

17. A carrier according to claim 16, wherein said organic anion is an aromatic anion.

18. A carrier according to claim 14, wherein said quaternary ammonium salt has a solubility to water of less than 1.0 g/100 g ($H_2O$, 20° C.).

19. A carrier according to claim 14, wherein said quaternary ammonium salt is added in an amount ranging from 0.5% by weight to 30% by weight based on said resin.

20. A carrier according to claim 16, wherein said resin comprises a vinyl resin.

21. A carrier according to claim 20, wherein said vinyl resin comprises an acrylic copolymer resin.

22. A carrier according to claim 21, wherein said acrylic copolymer resin comprises a styrene/2-hydroxyethyl methacrylate/methyl methacrylate copolymer.

23. A carrier according to claim 14, wherein the carrier core particles are coated with said coating resin material in a coating weight that provides a resin solid content ranging from 0.1% by weight to 30% by weight.

24. A carrier according to claim 14, wherein said carrier has a particle diameter ranging from 10 to 1,000 μm.

25. A carrier according to claim 1, wherein said coating resin material is formed of a solution comprising a resin and said quaternary ammonium salt, and said quaternary ammonium salt is dissolved in a solvent in which said quaternary ammonium salt has a solubility of not less than 1.0 g/100 g (solvent).

26. A carrier according to claim 25, wherein $R_1$, $R_2$ and $R_3$ each are an alkyl group or an aryl group and $R_1$, $R_2$ and $R_3$ may be the same or different from each other; $R_4$ is a substituted or unsubstituted alkyl group, a substituted or unsubstituted aryl group or an aralkyl group and A represents an organic anion.

27. A carrier according to claim 25, wherein $R_4$ is a group represented by the following formula:

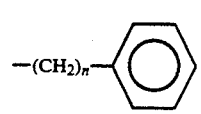

wherein n is an integer of 0, 1, 2 or 3.

28. A carrier according to claim 25, wherein $R_4$ represents an alkyl group.

29. A carrier according to claim 25, wherein the A in the formula of said quaternary ammonium salt represents an organic anion.

30. A carrier according to claim 29, wherein said organic anion is an aromatic anion.

31. A carrier according to claim 29, wherein said quaternary ammonium salt has a solubility to water of less than 1.0 g/100 g ($H_2O$, 20° C.).

32. A carrier according to claim 25, wherein said quaternary ammonium salt is added in an amount ranging from 0.5% by weight to 30% by weight based on said resin.

33. A carrier according to claim 25, wherein said resin comprises a vinyl resin.

34. A carrier according to claim 33, wherein said vinyl resin comprises an acrylic copolymer resin.

35. A carrier according to claim 34, wherein said acrylic copolymer resin comprises a styrene/2-hydroxyethyl methacrylate/methyl methacrylate copolymer.

36. A carrier according to claim 25, wherein the carrier core particles are coated with said coating resin material in a coating weight that gives a resin solid content ranging from 0.1% by weight to 30% by weight.

37. A carrier according to claim 25, wherein said carrier has a particle diameter ranging from 10 to 1,000 μm.

38. A two-component type developer for developing an electrostatic image, comprising a toner and a carrier, wherein said carrier comprises carrier core particles and a coating resin material, the surfaces of said carrier core particles are each coated with the coating resin material, and said coating resin material comprises a resin having an hydroxyl number of 1 to 100 (KOH mg/g) and a quaternary ammonium salt represented by the following formula:

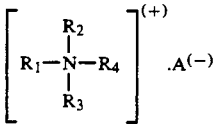

wherein $R_1$, $R_2$, $R_3$ and $R_4$ each are an alkyl group, an aryl group or an aralkyl group and $R_1$, $R_2$, $R_3$ and $R_4$ may be the same or different from each other; and A is an organic anion, an isopolyacid ion or a heteropolyacid ion.

39. A two-component type developer according to claim 38, wherein said quaternary ammonium salt is a lake compound.

40. A two-component type developer according to claim 38, wherein $R_4$ is an aryl group or an aralkyl group.

41. A two-component type developer according to claim 38, wherein $R_1$, $R_2$ and $R_3$ are an alkyl group or an aryl group; and $R_4$ is a group represented by the following formula:

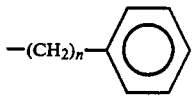

wherein n is an integer of 0, 1, 2 or 3.

42. A two-component type developer according to claim 40, wherein the A in the formula of said quaternary ammonium salt represents an organic anion.

43. A two-component type developer according to claim 42, wherein said organic anion is an aromatic anion.

44. A two-component type developer according to claim 40, wherein said quaternary ammonium salt has a solubility in water of less than 1.0 g/100 g ($H_2O$, 20° C.).

45. A two-component type developer according to claim 40, wherein said quaternary ammonium salt is added in an amount ranging from 0.5% by weight to 30% by weight based on said resin.

46. A two-component type developer according to claim 40, wherein said resin comprises a vinyl resin.

47. A two-component type developer according to claim 46, wherein said vinyl resin comprises an acrylic copolymer resin.

48. A two-component type developer according to claim 47, wherein said acrylic copolymer resin comprises a styrene/2-hydroxyethyl methacrylate/methyl methacrylate copolymer.

49. A two-component type developer according to claim 40, wherein the carrier core particles are coated with said coating resin material in a coating weight that provides a resin solid content ranging from 0.1% by weight to 30% by weight.

50. A two-component type developer according to claim 40, wherein said carrier has a particle diameter ranging from 10 to 1,000 μm.

51. A two-component type developer according to claim 38, wherein $R_4$ represents an alkyl group.

52. A two-component type developer according to claim 38, wherein $R_1$, $R_2$, $R_3$ and $R_4$ each represents an alkyl group.

53. A two-component type developer according to claim 51, wherein the A in the formula of said quaternary ammonium salt represents an organic anion.

54. A two-component type developer according to claim 53, wherein said organic anion is an aromatic anion.

55. A two-component type developer according to claim 53, wherein said quaternary ammonium salt has a solubility to water of less than 1.0 g/100 g ($H_2O$, 20° C.).

56. A two-component type developer according to claim 51, wherein said quaternary ammonium salt is added in an amount ranging from 0.5% by weight to 30% by weight based on said resin.

57. A two-component type developer according to claim 51, wherein said resin comprises a vinyl resin.

58. A two-component type developer according to claim 57, wherein said vinyl resin comprises an acrylic copolymer resin.

59. A two-component type developer according to claim 58, wherein said acrylic copolymer resin comprises a styrene/2-hydroxyethyl methacrylate/methyl methacrylate copolymer.

60. A two-component type developer according to claim 51, wherein the carrier core particles are coated with said coating resin material in a coating weight that provides a resin solid content ranging from 0.1% by weight to 30% by weight.

61. A two-component type developer according to claim 51, wherein said carrier has a particle diameter ranging from 10 to 1,000 μm.

62. A two-component type developer according to claim 38, wherein said coating resin material is formed of a solution comprising a resin and said quaternary ammonium salt, and said quaternary ammonium salt is dissolved in a solvent to which said quaternary ammonium salt has a solubility of not less than 1.0 g/100 g (solvent).

63. A two-component type developer according to claim 62, wherein $R_1$, $R_2$ and $R_3$ each are an alkyl group or an aryl group and $R_1$, $R_2$ and $R_3$ may be the same or different from each other; $R_4$ represents a substituted or unsubstituted alkyl group, a substituted or unsubstituted aryl group or an aralkyl group and A represents an organic anion.

64. A two-component type developer according to claim 62, wherein $R_4$ is a group represented by the following formula:

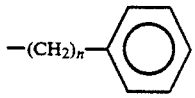

wherein n is an integer of 0, 1, 2 or 3.

65. A two-component type developer according to claim 62, wherein $R_4$ represents an alkyl group.

66. A two-component type developer according to claim 62, wherein the A in the formula of said quaternary ammonium salt represents an organic anion.

67. A two-component type developer according to claim 65, wherein said organic anion is an aromatic anion.

68. A two-component type developer according to claim 62, wherein said quaternary ammonium salt has a solubility to water of less than 1.0 g/100 g ($H_2O$, 20° C.).

69. A two-component type developer according to claim 62, wherein said quaternary ammonium salt is added in an amount ranging from 0.5% by weight to 30% by weight based on said resin.

70. A two-component type developer according to claim 62, wherein said resin comprises a vinyl resin.

71. A two-component type developer according to claim 70, wherein said vinyl resin comprises an acrylic copolymer resin.

72. A two-component type developer according to claim 71, wherein said acrylic copolymer resin has a hydroxyl group.

73. A two-component type developer according to claim 62, wherein the carrier core particles are coated with said coating resin material in a coating weight that provides a resin solid content ranging from 0.1% by weight to 30% by weight.

74. A two-component type developer according to claim 62, wherein said carrier has a particle diameter ranging from 10 to 1,000 μm.

75. An image forming method comprising:

developing a latent image by employing a two-component type developer comprising a toner and a carrier, under application of a bias voltage at a developing zone; wherein said carrier comprises carrier core particles and a coating resin material, the surfaces of said carrier core particles are each coated with the coating resin material and said coating resin material comprises a resin having an hydroxyl number of 1 to 100 (KOH mg/g) and a quaternary ammonium salt represented by the following formula:

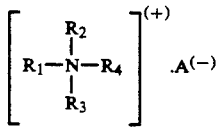

wherein $R_1$, $R_2$, $R_3$ and $R_4$ each are an alkyl group, an aryl group or an aralkyl group and $R_1$, $R_2$, $R_3$ and $R_4$ may be the same or different from each other; and A is an organic anion, an isopolyacid ion or a heteropolyacid ion.

76. An image forming method according to claim 75, wherein said developer comprises any one of the developers according to claims 39 to 74.

77. An image forming method according to claim 75, wherein said bias voltage is applied by overlapping an alternating electric field and a direct-current electric field.

78. An image forming method according to claim 77, wherein said alternating electric field is not more than 2,000 Vpp.

79. An image forming method according to claim 77, wherein said direct-current electric field is not more than 1,000 Vpp.

80. An image forming method according to claim 75, wherein the distance e of the gap at which a developing sleeve and a latent image supporting member are opposed is in the range of from 50 μm to 800 μm.

81. An image forming method according to claim 75, wherein the distance d between the lower end of a non-magnetic blade and the surface of a developing sleeve is in the range of from 100 μm to 900 μm.

82. An image forming method according to claim 75, wherein an angle $\theta_1$ formed by imaginary lines $L_1$ and $L_2$ is in the range of from −5° to 35°.

83. An image forming method according to claim 75, wherein said photosensitive member comprises OPC.

84. An image forming method according to claim 75, wherein said photosensitive member comprises α-Si.

* * * * *

UNITED STATES PATENT AND TRADEMARK OFFICE

CERTIFICATE OF CORRECTION

PATENT NO. : 5,215,848

DATED : June 1, 1993

INVENTOR(S) : TAKESHI IDEDA, ET AL.

It is certified that error appears in the above-identified patent and that said Letters Patent is hereby corrected as shown below:

IN [57] ABSTRACT

Line 1, "1." should be deleted.

COLUMN 1

Line 10, "composes" should read --comprises--.

COLUMN 2

Line 4, "the fusing" should read --fusing--.

COLUMN 4

Line 6, "of;" should read --of:--.
Line 42, "formula;" should read --formula:--.
Line 57, "DRAWING" should read --DRAWINGS--.
Line 61, "diagramatically" should read --diagrammatically--.

COLUMN 9

Line 37, "0.5" should read --0.5 wt. %--.

COLUMN 11

Line 27, "reference" should read --reference to--.
Line 67, "container 112" should read --container 122--.

COLUMN 13

Line 25, "ranges" should read --range--.

--

UNITED STATES PATENT AND TRADEMARK OFFICE

CERTIFICATE OF CORRECTION

PATENT NO. : 5,215,848

DATED : June 1, 1993

INVENTOR(S) : TAKESHI IDEDA, ET AL.

It is certified that error appears in the above-identified patent and that said Letters Patent is hereby corrected as shown below:

COLUMN 14

Line 17, "apart" should read --part--.

COLUMN 15

Line 25, "ration:" should read --ratio:--.
Line 45, "uniformely" should read --uniformly--.
Line 57, "thereafter" should be deleted.
Line 58, "cooled," should read --being cooled,--.

COLUMN 17

Line 5, "ration:" should read --ratio:--.
Line 63, "uniformely" should read --uniformly--.

COLUMN 19

Line 25, "uniformely" should read --uniformly--.

COLUMN 20

Line 3, "Comparative Example 2 and Example 2" should read --Comparative Example 3 and Example 3--.
Line 33, "uniformely" should read --uniformly--.

COLUMN 21

Line 54, "uniformely" should read --uniformly--.
Line 67, "cooled," should read --being cooled,--.

--

UNITED STATES PATENT AND TRADEMARK OFFICE

CERTIFICATE OF CORRECTION

PATENT NO. : 5,215,848

DATED : June 1, 1993

INVENTOR(S) : TAKESHI IDEDA, ET AL.

It is certified that error appears in the above-identified patent and that said Letters Patent is hereby corrected as shown below:

COLUMN 24

Line 1, "(θ1:" should read --($\theta_1$:--.
Line 49, "uniformely" should read --uniformly--.

COLUMN 25

Line 66, "uniformely" should read --uniformly--.

COLUMN 26

Line 67, "(solubilityin" should read --(solubility in--.

COLUMN 27

Line 14, "uniformely" should read --uniformly--.
Line 26, "cooled," should read --being cooled,--.

COLUMN 28

Line 23, "Table 5," should read --Table 3,--.

COLUMN 29

Line 25, "uniformely" should read --uniformly--.

COLUMN 30

Lines 5-6, "Compara-tive Example 9" should read --Example 9--.
Line 38, "solubility" should read --(solubility--.
Line 54, "uniformely" should read --uniformly--.
Line 62, "staning" should read --standing--.

--

UNITED STATES PATENT AND TRADEMARK OFFICE

CERTIFICATE OF CORRECTION

PATENT NO. : 5,215,848

DATED : June 1, 1993

INVENTOR(S) : TAKESHI IDEDA, ET AL.

It is certified that error appears in the above-identified patent and that said Letters Patent is hereby corrected as shown below:

COLUMN 32

Line 2, "uniformely" should read --uniformly--.

COLUMN 33

Line 17, "an" should read --a--.
Line 37, "are" should read --each are--.

COLUMN 35

Line 35, "an" should read --a--.
Line 58, "are" should read --each are--.

COLUMN 38

Line 12, "an" should read --a--.

Signed and Sealed this

Twenty-second Day of March, 1994

Bruce Lehman

*Attest:*

BRUCE LEHMAN

*Attesting Officer*

*Commissioner of Patents and Trademarks*